US006148169A

United States Patent [19]

Tsukamoto

[11] Patent Number: 6,148,169

[45] Date of Patent: Nov. 14, 2000

[54] DEVICE FOR FIXING AN IMAGE ON A RECORDING MEDIUM

[75] Inventor: Takeo Tsukamoto, Kanagawa, Japan

[73] Assignee: Ricoh Company, Ltd., Tokyo, Japan

[21] Appl. No.: 09/412,978

[22] Filed: Oct. 6, 1999

[30] Foreign Application Priority Data

| | | | |
|---|---|---|---|
| Oct. 6, 1998 | [JP] | Japan | 10-283889 |
| Mar. 10, 1999 | [JP] | Japan | 11-063375 |
| Mar. 10, 1999 | [JP] | Japan | 11-063380 |
| Jun. 18, 1999 | [JP] | Japan | 11-172000 |

[51] Int. Cl.[7] ..... G03G 15/20

[52] U.S. Cl. ..... 399/328; 219/216; 399/333

[58] Field of Search ..... 399/328–331, 399/333, 339; 219/216; 118/60; 347/156; 430/99, 124

[56] References Cited

U.S. PATENT DOCUMENTS

| | | | |
|---|---|---|---|
| 3,921,573 | 11/1975 | Thettu | 118/60 X |
| 5,408,070 | 4/1995 | Hyllberg | 219/216 X |
| 5,463,454 | 10/1995 | Yasuda et al. | 399/328 |
| 5,652,080 | 7/1997 | Yoshino et al. | 430/119 |
| 5,666,616 | 9/1997 | Yoshino et al. | 399/240 |
| 5,724,637 | 3/1998 | Senba et al. | 399/333 |
| 5,893,019 | 4/1999 | Yoda et al. | 399/328 X |
| 5,923,930 | 7/1999 | Tsukamoto et al. | 399/237 |
| 5,987,294 | 11/1999 | Yoda et al. | 399/328 |
| 6,002,106 | 12/1999 | Kataoka et al. | 219/216 |

FOREIGN PATENT DOCUMENTS

| | | |
|---|---|---|
| 2606843 B2 | 2/1997 | Japan . |
| 2781390 B2 | 5/1998 | Japan . |

*Primary Examiner*—Sophia S. Chen

*Attorney, Agent, or Firm*—Oblon, Spivak, McClelland, Maier & Neustadt, P.C.

[57] ABSTRACT

A device for fixing an image formed on a recording medium by fine colored particles dispersed in a solvent and capable of at least temporarily holding a charge in the solvent is disclosed. A potential difference is set up between the surface of a contact member and that of a pressing member via a recording medium in order to fix the colored particles on the recording medium. The device has a simple, miniature configuration and a high fixing ability.

38 Claims, 14 Drawing Sheets

DEVICE FOR FIXING AN IMAGE ON A RECORDING MEDIUM

FIELD OF THE INVENTION

Background of the Invention

The present invention relates to a device for fixing an image formed on a paper or similar recording medium by an electrophotographic method, an ink jet recording method, a printing method using a master or similar image forming method using a developing liquid consisting of a solvent and fine colored particles capable of at least temporarily holding a charge in the solvent. More particularly, the present invention relates to a device for fixing an image formed on a recording medium by electrophotographically forming a latent image on an image carrier and then developing the latent image with a developing liquid consisting of a solvent and colored particles dispersed in the solvent, an image formed by directly ejecting liquid ink consisting of a solvent and colored particles dispersed in the solvent by an ink jet recording method, or an image formed by transferring the liquid ink to a recording medium via a master

DISCUSSION OF THE BACKGROUND

It is a common practice with electrophotography to form a latent image on an image carrier and then develop the latent image with a developing liquid consisting of a carrier or solvent and toner, or fine colored particles, disposed in the carrier. The resulting toner image is transferred from the image carrier to a paper or similar recording medium and then fixed on the paper. When an image fixing device applicable to this type of process uses a volatile carrier, a fixing method using heat is predominant over the other fixing methods. Conventional fixing methods using heat are generally classified into two types, i.e., a contact type fixing method causing a roller or a belt heated to a preselected temperature to contact the toner image and a noncontact type fixing method heating the toner image by the radiation of, e.g., infrared rays. As for heat transfer efficiency, the contact type fixing method is far more desirable than the noncontact type fixing method.

In the image fixing device using the contact type fixing method, even when the carrier is left in the toner image, it is partly or almost entirely evaporated by heat during fixation. It is therefore possible to increase coupling forces acting between the toner particles and between the toner particles and the recording medium by pressure. As a result, the toner image can be desirably fixed on the recording medium.

However, the problem with the volatile carrier is that an arrangement for handling the vaporized carrier is required. This limits the applicable range of the fixing device of the type described. A current trend in the imaging art is, therefore, toward the use of a nonvolatile carrier containing no volatile components. A nonvolatile carrier, however, brings about another problem that it exists between the toner particles forming the toner image and between the toner particles and the paper even when the particles are softened or melted by heat. As a result, the carrier obstructs the cohesion of the toner particles and the adhesion of the particles to the paper at the time of pressing, i.e., the fixation of the toner image. Moreover, transfer of the toner to a heat roller or contact member, i.e., so-called offset, occurs. In addition, the toner image carried on the paper is disturbed.

To solve the above problems, Japanese Patent Laid-Open Publication No. 9-281753, for example, proposes an image fixing device using a Johnson-Rahbec effect. The device taught in this document fixes a toner image formed on a paper or similar recording medium by use of a developing liquid consisting of a carrier and toner dispersed in the carrier. Specifically, the device includes a conductive roller or electrode and another conductive roller capable of respectively contacting the front or image surface and the rear of a paper. A current is caused to flow between the two conductive rollers in the direction of thickness of the toner image, so that the toner particles firmly cohere together and firmly adhere to the paper (preliminary fixation hereinafter). After the preliminary fixation, heat and pressure are applied to the paper between a heat roller and a press roller for thereby fixing the toner image on the paper (actual fixation hereinafter). However, this kind of device is not desirable because the preliminary fixation and actual fixation each using exclusive rollers lower the fixing efficiency and obstruct the compact configuration of the device.

Assume that to implement both of the preliminary fixation and actual fixation with a single heat roller and a single press roller, the heat roller is provided with resistance low enough to cause a current to flow between the heat roller and the press roller in the direction of thickness of the toner image. Then, a crash or similar defect existing in the heat roller would cause abnormal discharge to occur at the position where the heat roller and press roller contact. The resulting concentration of a current would destruct the heat roller and obstruct expected fixation.

Another problem with the conventional fixing device using the heat roller is that as the surface temperature required of the heat roller rises relative to room temperature, a period of time necessary for the surface temperature to reach the required surface temperature, i.e., a warm-up time, increases. In addition, power consumption is aggravated. Moreover, the heat roller with such a high surface temperature causes the paper to crease or curl due to a decrease in water content and causes the electrical resistivity of the paper to drop, thereby varying image transfer conditions. For example, a full-color mode operation includes steps of forming a first image on a paper, fixing the first image, and forming a second image above the first image. In this case, if the electrical resistivity of the paper is lowered by the formation of the first image, a transfer bias must be increased at the time of formation of the second image; in the worst case, an adequate transfer bias for the second image is not available, rendering the resulting full-color image defective.

It has been customary with the image fixing device using heat to form one or both of the heat roller and press roller by using rubber, sponge or similar elastic material. The press roller and heat roller form a nip therebetween and fix a toner image formed on a paper or similar recording medium while conveying the paper through the nip. To form a nip broad enough to promote fixation, the device is constructed such that heat roller and press roller exert a great pressing force or such that a either the heat roller or the press roller has low hardness. The pressing force may be increased by increasing the mechanical strength of the two rollers, i.e., the volume of the core of each roller. However, an increase in the strength of the heat roller results in an increase in the heat capacity of the heat roller and therefore an increase in warm-up time. On the other hand, should the hardness of the heat roller or that of the press roller formed of an elastic material be reduced, the roller would suffer from permanent strain and decrease in durability.

In light of the above, use may be made of a heat belt or a heat film for fixing a toner image on a paper or similar recording medium. The heat belt and heat film each can form a nip width great enough to insure stable fixation without resorting to a great pressing force. Further, by adequately devising heat transfer between the belt or the film heated and the paper, it is possible to reduce offset.

However, the above heat belt or heat film scheme sophisticates the construction of the fixing device, compared to the heat roller and press roller scheme. Moreover, the heat belt is apt to be displaced to either side. In addition, the sophisticated construction and the displacement of the heat belt lower stability and make the device not feasible for high-speed applications.

Technologies relating to the present invention are also disclosed in, e.g., Japanese Patent Nos. 2,781,390 and 2,606,843.

SUMMARY OF THE INVENTION

It is therefore an object of the present invention to provide a compact, miniature image fixing device having a high fixing ability.

In accordance with the present invention, a device for fixing an image formed on a recording medium by fine colored particles dispersed in a solvent and capable of at least temporarily holding a charge in the solvent includes a contact member for contacting a first surface of the recording medium carrying the image, and a pressing member for pressing the recording medium against the contact member via a second surface of the recording medium opposite to the first surface to thereby press the image. The contact member is implemented as a heat roller made up of a conductive roller serving as a conductive portion, and a high resistance, ceramic thin film formed on the surface of the conductive roller. The pressing member is formed of an at least semi-conductive material. A current is caused to flow between the conductive roller and the pressing member via the recording medium.

Also, in accordance with the present invention, a device for fixing an image formed on a recording medium by fine colored particles dispersed in a solvent and capable of at least temporarily holding a charge in the solvent includes a contact member for contacting a first surface of the recording medium carrying the image, and a pressing member for pressing the recording medium against the contact member via a second surface of the recording medium opposite to the first surface to thereby press the image. A potential difference is set up between the surface of the contact member and that of the pressing member via the recording medium. In a preferred embodiment, a current is caused to flow between the surface of the conductive roller and that of the pressing member via the recording medium.

Further, in accordance with the present invention, a device for fixing an image formed on a recording medium by a developing liquid in which a carrier is partly or entirely implemented by a nonvolatile solvent includes a heat roller, a heat roller drive source for driving the heat roller, and a plurality of backup rollers sequentially arranged along the circumference of the heat roller. The backup rollers each press the recording medium toward the heat roller with a force which is less than 50 g/cm inclusive for a unit axial length of the backup roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
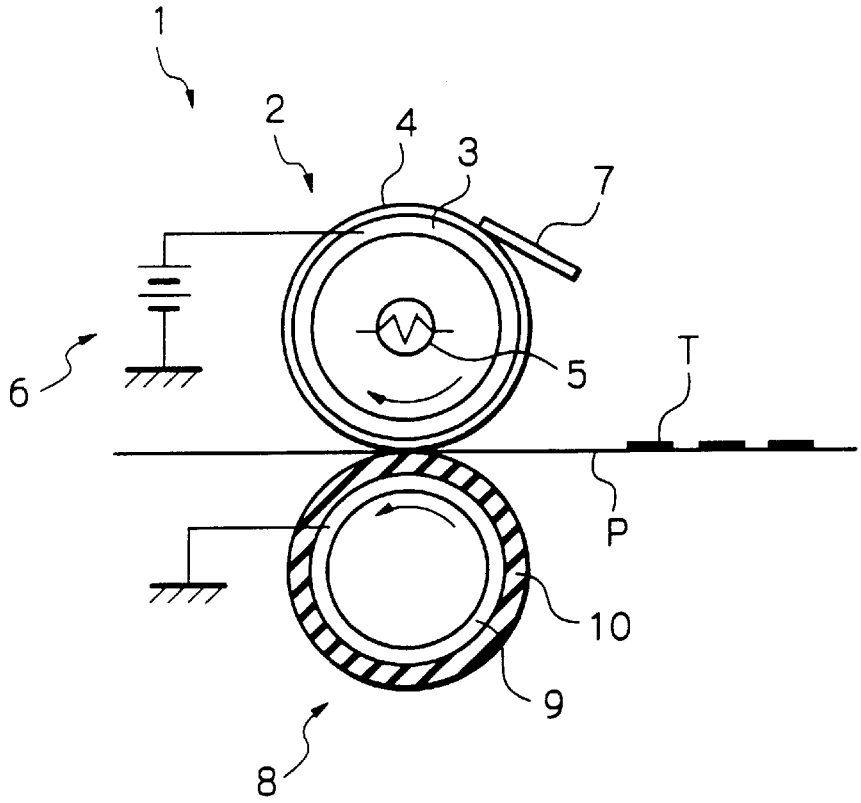
FIG. 1 is a side elevation showing a first embodiment of the image fixing device in accordance with the present invention.

Preferred embodiments of the fixing device in accordance with the present invention will be described hereinafter. References numerals used in each illustrative embodiment are independent of reference numerals used in the other illustrative embodiments; identical reference numerals in the illustrative embodiments do not always designate identical structural elements.

First Embodiment

Referring to FIG. 1 of the drawings, a fixing device embodying the present invention is shown and generally designated by the reference numeral 1. As shown, the fixing device 1 includes a heat roller or contact member 2 made up of an aluminum roller or core 3 and an anode oxide film 4 covering the outer periphery of the roller 3. The aluminum roller 3 is a specific form of a conductive roller and has an outside diameter of 45 mm. The anode oxide film 4 is implemented by a ceramic film having a high resistance and as thin as 60 $\mu$m. As for an electrical resistance characteristic, the anode oxide film 4 exhibits a high insulating ability when the potential difference in the direction of thickness is small, but decreases in resistance and allows a current to flow therethrough as the potential difference exceeds a preselected value. The heat roller 2 has a halogen lamp or heat source 5 thereinside. At the time of fixation, the halogen lamp 5 is turned on to heat the surface layer or the heat roller 2. A bias power source 6 is connected to the aluminum roller 3 for applying a bias voltage to the roller 3. A cleaning blade 7 adjoins the anode oxide film 4 of the heat roller 2 and has a free edge thereof contacting the film 4. The cleaning blade 7 removes mainly a solvent deposited on the surface of the anode oxide film 4.

A press roller or pressing member 8 extends in parallel to the heat roller 2 and is made up of a metallic roller or core 9 and a conductive rubber 10 covering the outer periphery of the roller 9. In the illustrative embodiment, the conductive rubber 10 is implemented by EPDM and has a thickness of about 5 mm and a volume resistivity of $10^6$ Ω.cm to $10^8$ Ω.cm. The metallic roller 9 is connected to ground. The heat roller 2 and press roller 8 are pressed against each other by a preselected pressure, forming a nip therebetween. There are also shown in FIG. 1 a paper or similar recording medium P and a toner image T formed on the paper P.

Figure 2:
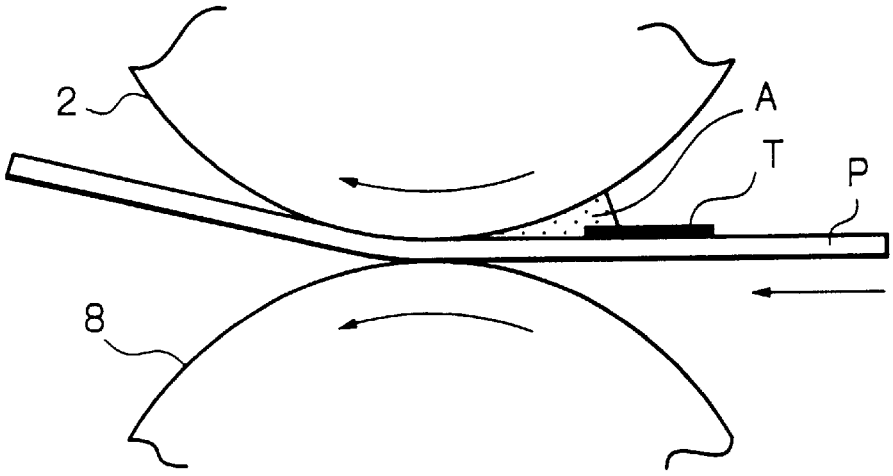
FIG. 2 is an enlarged view showing a stable discharge region available between the surface of a heat roller included in the first embodiment and a paper or similar recording medium.

As shown in FIG. 2, a stable discharge region A is formed between the heat roller 2 and the paper P. Specifically, when a bias voltage is applied from the bias roller 6 to the aluminum roller 3 to set up a preselected potential difference between the roller 6 and the metallic roller 9, discharge stably occurs between the surface of the heat roller 2 and the paper P in the above region A.

The heat roller 2 and press roller 8 convey the paper P carrying the toner image T thereon. The toner image T is formed by fine colored particles, i.e., toner particles (simply toner hereinafter) dispersed in a carrier or solvent. The toner includes resin, pigment, substances dispersed in the resin, and a charge control agent. The toner dispersed in the carrier is charged by interchanging charges with the constituents of the carrier. The toner in the carrier tends to be charged to either positive polarity or negative polarity, depending on the kind of the resin, substances existing in the resin other than the pigment, and charge control agent. In the following description, the carrier is assumed to be implemented by dimethylpolysiloxane while the toner is assumed to be charged to positive polarity.

When the temperature of the heat roller 2 is constant, the following relations hold between the current to flow through the paper P between the heat roller 2 and the press roller 8 and the degree of fixation of the toner image T on the paper P, and between the above current and the offset of the heat roller 2. For measurement, the heat roller 2 was held at a temperature of 80° C. which is between the glass transition point Tg and the melting point Tm of the toner, as will be described with reference to FIG. 4 later.

Figure 3:
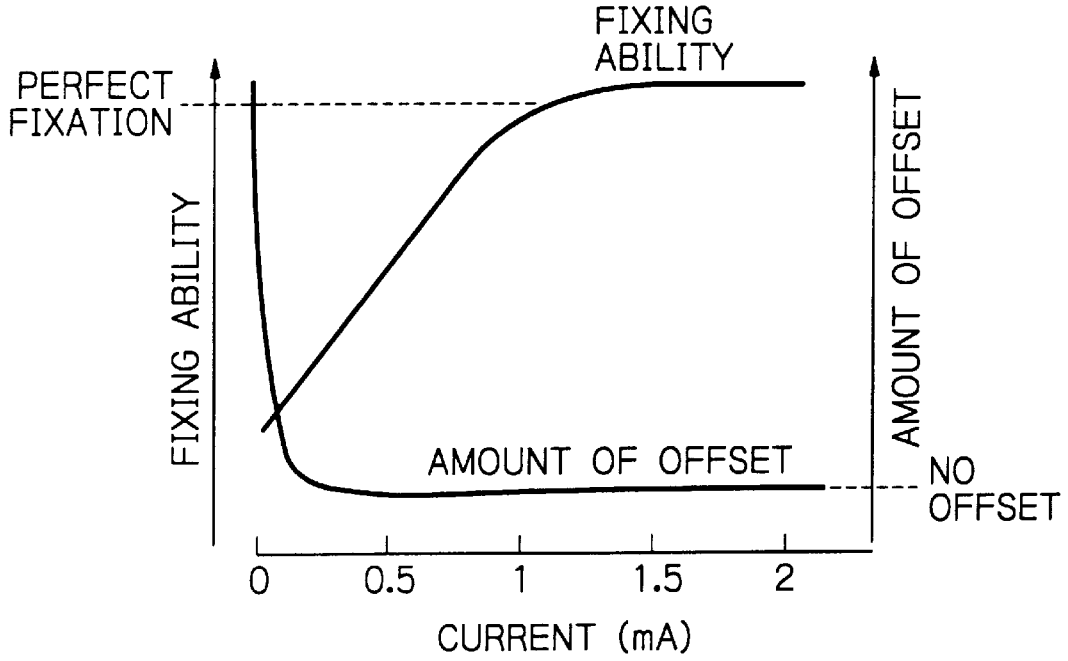
FIG. 3 is a graph showing a relation between a current to flow through the paper and the degree of fixation of a toner image on the paper between the heat roller and a press roller, and a relation between a current to flow through the paper between the heat roller and the press roller and the offset of the heat roller.

As shown in FIG. 3, as the current flowing through the paper P between the heat roller 2 and the press roller 8 increased, the offset of the heat roller 2 decreased while the fixation of the toner image T on the paper P was improved. When the total current was above 1.5 mA, no offset occurred on the heat roller 2 while the toner image T was perfectly fixed on the paper P. Why such two different conditions were satisfied at the same time is presumably because discharge occurs between the surface of the heat roller 2 and that of the paper P via an air layer and feeds a charge to the toner image T on the paper P.

In light of the above, a series of researches and experiments were conducted to find a desirable material for forming the high resistance thin film. The researches and experiments showed that ceramics little susceptible to discharge as to the destruction of the structure were desirable. Particularly, ceramics mainly constituted by aluminum were excellent in resistance as well.

A thin film mainly constituted by aluminum oxide is attainable by the ceramic coating of the aluminum roller 3. For example, the surface layer of the aluminum roller 3 may be subjected to anode oxidation, or a layer mainly constituted by aluminum oxide may be formed on the aluminum roller 3 by PVD, CVD, plasma CVD or similar deposition or by flame spraying. If the resulting ceramic thin film has a porous surface, pores may be sealed or filled up by any one of conventional schemes in order to further stabilize the discharge.

Assume that the current of 1.5 mA constantly flows through the paper P between the heat roller 2 and the press roller 8. Then, the following relations experimentally determined hold between the temperature of the heat roller 2 and the degree of fixation of the toner image T on the paper P, and between the above temperature and the offset of the heat roller 2.

Figure 4:
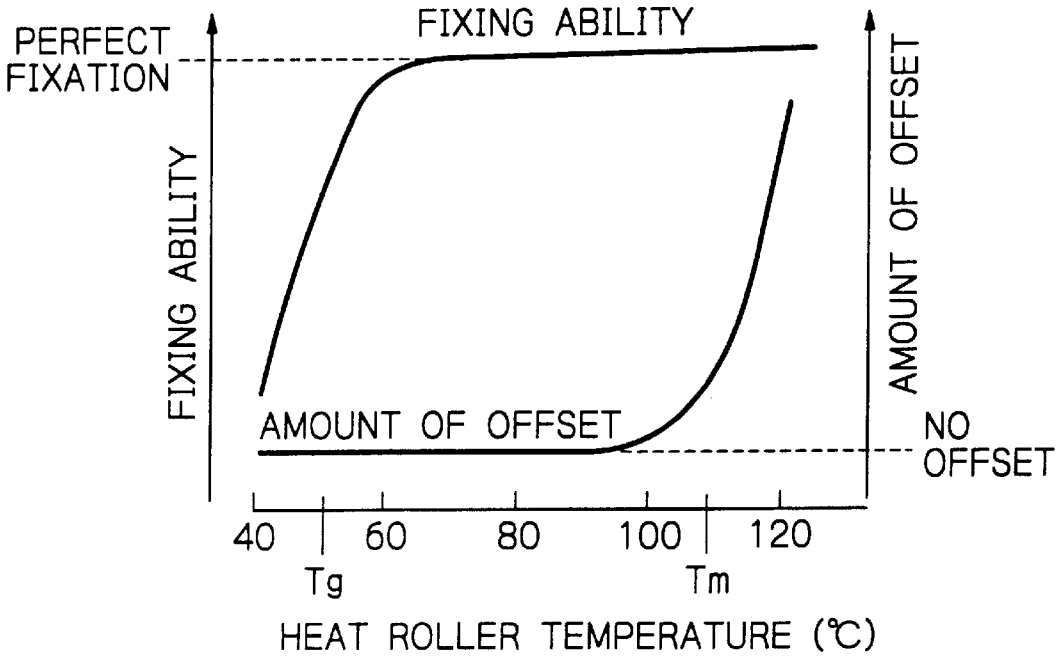
FIG. 4 is a graph showing a relation between the temperature of the heat roller and the degree of fixation of the toner image and a relation between the above temperature and the offset of the heat roller.

As shown in FIG. 4, when the temperature of the heat roller 2 rises, the fixation of the toner image T on the paper P is improved. However, offset suddenly occurs when the temperature of the heat roller 2 increases above a preselected value. By comparing such a phenomenon and the properties of the toner, it was found that fixation was desirable at and above the glass transition point Tg of the toner while the offset began to sharply increase at a temperature slightly above the melting point Tm. It follows that by heating the heat roller 2 to a temperature above the glass transition point Tg of the toner, but below the melting point Tm of the same, it is possible to implement desirable fixation without any offset of the heat roller 2.

The operation of the fixing device 1 will be described hereinafter. Assume that the current is 1.5 mA and that the temperature of the heat roller 2 is 80° C. which is between the glass transition point Tg and the melting point Tm. The bias power source 6 applies a bias voltage to the aluminum roller 3 of the heat roller 2 in order to set up a preselected potential difference between the roller 3 and the metallic roller 9. The paper P with the toner image T is conveyed toward the nip between the heat roller 2 and the press roller 8. As soon as the toner image T enters the stable discharge region A, a charge is fed to the toner forming the toner image T. When the paper P reaches the nip between the heat roller 2 and the press roller 8, a current flows from the heat roller 2 to the press roller 8 via the paper P and causes intense coupling forces to act between the particles of the toner and between the toner and the paper P. As a result, the toner firmly adheres to the paper P with its particles firmly cohering together. At this instant, the carrier contained in the toner image T is forced out in the form of a carrier layer. That is, the toner image T separates into a toner layer and a carrier layer.

The heat roller 2 softens the toner with heat. While the paper P is conveyed through the above nip, the heat roller 2 presses the surface of the paper P carrying the toner image T while the press roller 8 presses the other surface of the paper P. As a result, the toner image T is fixed on the paper P. Although the carrier of the toner image T is partly transferred from the paper P to the surface of the heat roller 2, the cleaning blade 7 successfully removes the carrier from the heat roller 2 being rotated.

As stated above, a charge is applied to the toner forming the toner image T on the paper P when the toner image T enters the stable discharge region A adjoining the nip. When the toner image T reaches the nip, a current flowing through the paper P causes the toner image T to separate into a toner layer and a carrier layer. While the toner image T is conveyed through the nip, the toner is softened by the heat of the heat roller 2 and then pressed. Consequently, the toner image T is firmly fixed on the paper P without depositing on the heat roller 2.

The ceramic coating covering the heat roller 2, as stated earlier, provides the surface of the roller 2 with far greater wear resistance than the surface of a conventional roller implemented by, e.g., resin or rubber. The heat roller 2 therefore wears little despite its contact with the paper P and cleaning blade 7.

Figure 5:
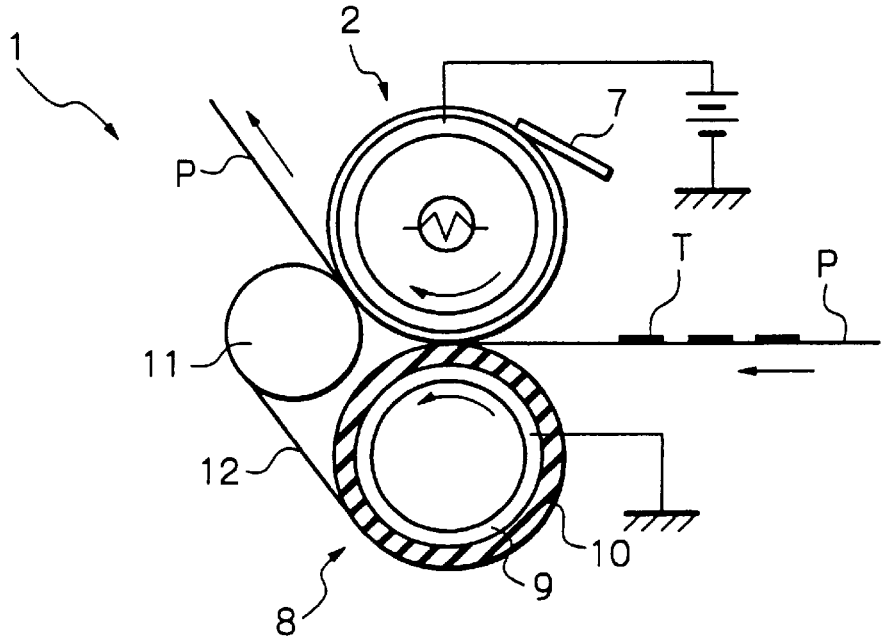
FIG. 5 is a side elevation showing a first modification of the first embodiment.

FIG. 5 shows a modification of the illustrative embodiment. As shown, a support roller 11 is located in the vicinity of the press roller 8. An endless belt or pressing member 12 is passed over the support roller 11 and the press roller 8. The heat roller 2 and belt 12 are pressed against each other, forming a nip therebetween. The belt 12 is formed of polyimide comparable in volume resistivity with conductive rubber customarily used to form an elastic roller.

The nip between the heat roller 2 and the belt 12 has a far greater width than the nip between the heat roller 2 and the press roller 8. Such a nip gives sufficient thermal energy to the toner image T carried on the paper P, allowing the fixing device to easily implement high speed fixation.

In the illustrative embodiment and its modification, the ceramic thin film having high resistance has a volume resistivity of $10^7$ Ω.cm or above. The conductive roller may therefore have a volume resistivity of $10^3$ Ω.cm or below. Aluminum forming the conductive roller 3 may be replaced with any other suitable metal, e.g., iron or stainless steel, taking account of the method of forming the ceramic thin film as well.

As stated above, the above embodiment and its modification each realize a simple, compact fixing device capable of surely fixing an image on a recording medium without any offset of a heat roller. More specific advantages achievable with the illustrative embodiment and its modification are as follows.

(1) An image is fixed on a recording medium between the heat roller and a pressing member. This makes the conventional preliminary fixation and actual fixation needless and thereby renders the fixing device compact.

(2) The heat roller has a conductive roller whose surface is implemented by a ceramic thin film. The surface of the heat roller is therefore resistant to structural destruction and has a high resistance highly resistant to a current. A uniform current can stably flow between the heat roller and the at least semiconductive pressing member over the entire range in the widthwise direction of the recording medium. This insures sufficient fixation of the image on the recording medium and prevents the toner from depositing on the heat roller more positively.

(3) The enhanced resistance of the surface of the heat roller to a current allows an amount of current great enough to obviate offset to flow between the conductive portion of the heat roller and the pressing member.

(4) The toner particles are capable of at least temporarily holding a charge in a solvent. Therefore, the current flowing between the heat roller and the pressing member causes the particles to firmly cohere together and firmly adhere to the recording medium, so that a solvent layer can be formed on the particles.

(5) When the ceramic thin film of the heat roller is mainly constituted by aluminum oxide, the thin film achieves an excellent electrical resistance characteristic, i.e., it is not fully insulating or too low in electrical resistance. In addition, aluminum oxide is inexpensive and easy to obtain.

(6) By subjecting the surface of the aluminum roller of the heat roller to anode oxidation, it is possible to form the ceramic thin film mainly constituted by aluminum oxide without resorting to post-treatment. It follows that a uniform current can stably flow between the heat roller and the pressing member over the entire range in the widthwise direction of the recording medium.

(7) The conductive roller of the heat roller can be formed of a material other than aluminum. Therefore, when the conductive roller is made ho low in order to promote rapid warm-up of the heat roller, the conductive roller may be formed of, e.g., iron for providing the heat roller with sufficient mechanical strength.

(8) Flame spraying may be used to form the ceramic thin film in a short period of time.

(9) When the pressing member is implemented as a semiconductive elastic roller, a stable nip can be easily formed between the heat roller and the elastic roller and allows a stable current to flow therethrough.

(10) The heat roller and an endless belt form a nip broad enough to apply sufficient thermal energy from the heat roller, increasing the fixing speed available with the fixing device.

(11) The heat roller is heated to a temperature between the glass transition point and the melting point of the toner. Therefore, sufficient fixation is achievable at the glass transition point. The fixing ability increases with an increase in the temperature of the heat roller and becomes maximum at a preselected temperature. Offset occurs little up to a preselected temperature below the melting point.

(12) Perfect fixation is attainable even when the temperature of the heat roller lies in a range narrower than the range between the glass transition point and the melting point of the toner.

Second Embodiment

Figure 6:
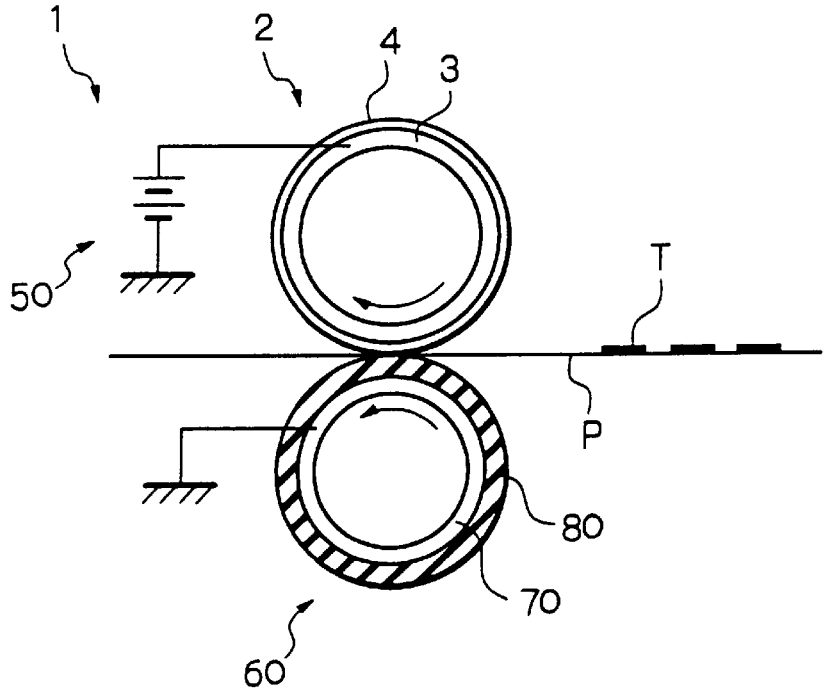
FIG. 6 is a side elevation showing a second embodiment of the image fixing device in accordance with the present invention.

An alternative embodiment of the present invention will be described with reference to FIG. 6. As shown, the fixing device 1 includes a contact roller or contact member 2 and a press roller 60 axially parallel to each other. The contact roller 2 is made up of an aluminum roller or core 3 and an anode oxide film 4 covering the surface of the roller 3 and having a high resistance. The anode oxide film 4 has a thickness of bout several ten microns. A bias power source 50 is connected to the aluminum roller 3 for applying a bias voltage thereto. The press roller 60, like the press roller 8 of FIG. 1, is made up of a metallic roller 70 and conductive rubber 80 covering the roller 70.

The contact roller 2 and press roller 60 are pressed against each other by a preselected pressure, forming a nip therebetween. When the paper P with the toner image T is brought to the above nip, the contact roller 2 presses the surface of the paper P carrying the toner image T while the press roller 60 presses the other surface of the paper P. The two rollers 2 and 60 each rotating in a particular direction, as indicated by an arrow in FIG. 6, convey the paper P.

Again, as for an electrical resistance characteristic, the anode oxide film 4 exhibits a high insulating ability when the potential difference in the direction of thickness is small, but decreases in resistance and allows a current to flow therethrough as the potential difference exceeds a preselected value. It was experimentally found that fixation of the toner image T on the paper P was improved as the amount of current flowing from the contact roller 2 to the press roller 60 via the paper P increased.

The pressing mechanism using the contact roller 2 and press roller 60 simplifies the construction of the fixing device 1.

Figure 7:
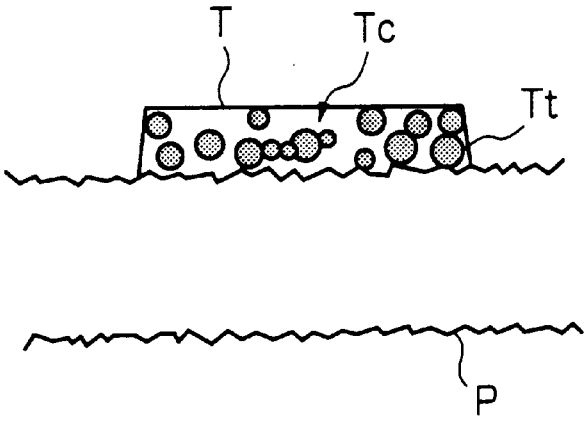
FIG. 7 is a sketch showing a toner image formed on a paper.

FIG. 7 is a sketch showing the toner image T formed on the paper P before fixation. As shown, the toner image T consists of a carrier or solvent Tc and toner particles Tt dispersed in the carrier Tc. The toner Tt includes resin, pigment, substances dispersed in the resin, and a charge control agent. The toner Tt dispersed in the carrier Tc is charged by interchanging charges with the carrier Tc or the constituents of the carrier Tc. The toner Tt in the carrier Tc tends to be charged to either positive polarity or negative polarity, depending on the kind of the resin, substances existing in the resin other than the pigment, and the charge control agent. Again, the carrier is assumed to be implemented by dimethylpolysiloxane while the toner is assumed to be charged to positive polarity.

Figure 8:
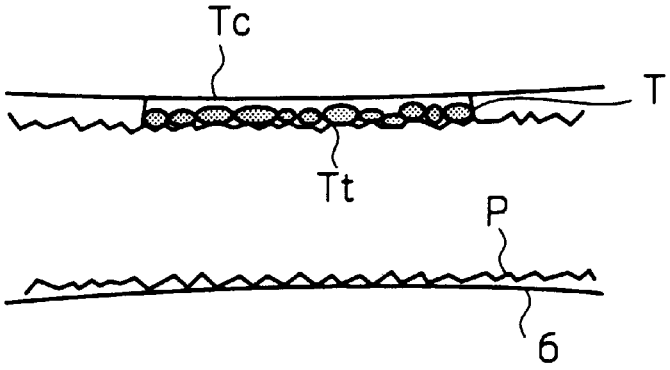
FIG. 8 is a sketch showing how a heat roller and a press roller included in the second embodiment fix the toner image on the paper.
Figure 9:
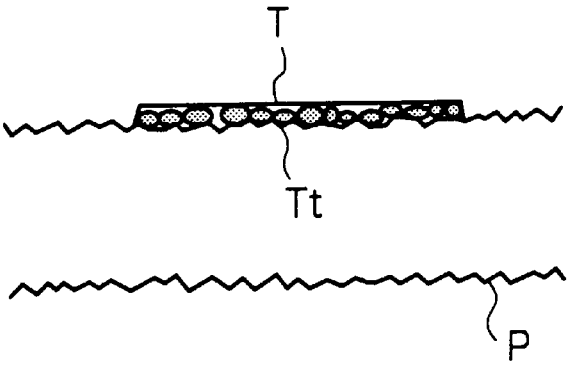
FIG. 9 is a sketch showing the toner image fixed on the paper.

The operation of the fixing device 1 will be described with reference to FIGS. 8 and 9. When the bias power source 50 applies a bias voltage to the aluminum roller 3 of the contact roller 2, the surface potential of the contact roller 2 rises above the surface potential of the press roller 60 with the result that an electric field is formed between the rollers 2 and 60. When the paper P with the toner image T is brought to the nip, the contact roller 2 presses the surface of the paper P carrying the toner image T while the press roller 60 presses the other surface of the paper P. The two rollers 2 and 60 each rotating in a particular direction, as mentioned earlier, convey the paper P through the nip. At this instant, the electric field formed between the rollers 2 and 60 causes the positively charged toner Tt of the toner image T to cohere together and adhere to the paper P. As a result, most of the carrier Tc is forced out toward the contact roller 2 and forms a carrier layer while the remaining carrier Tc is absorbed in the paper P.

At the intermediate portion of the nip, the contact roller 2 and press roller 60 respectively press the surface of the paper P carrying the toner image T and the other surface of the paper P. Consequently, intense coupling forces acts between the toner particles Tt and between the toner particles Tt and the paper P, thereby fixing the toner image Ton the paper P. When the toner image T moves away from the contact roller 2, part of the carrier Tc forming the carrier layer Tc' is transferred to and removed by the contact roller 2. This successfully obviates offset without resorting to fluorocarbon resin or similar material customarily used to provide the surface of the contact roller 2 with a parting ability.

Figure 10:
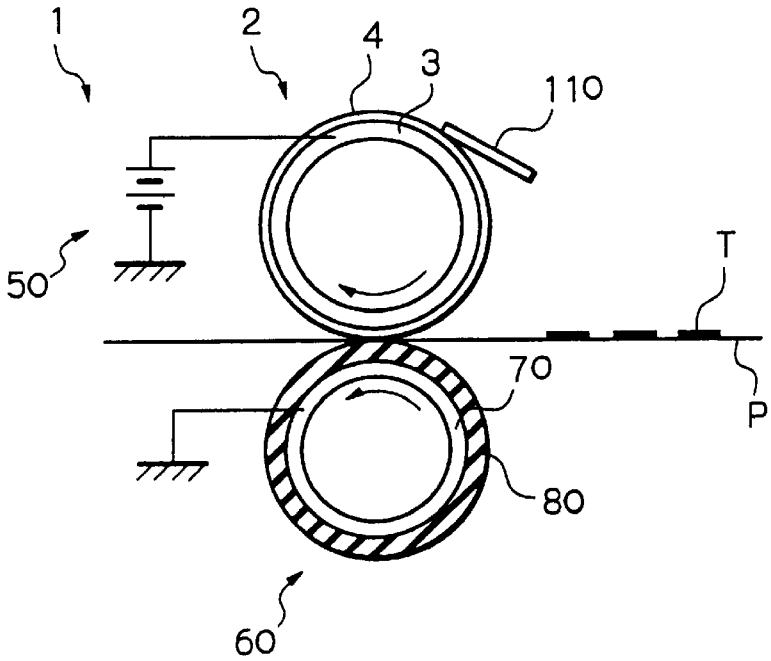
FIGS. 10–14 are side elevations each showing a particular modification of the second embodiment.

FIG. 10 shows a first modification of the second embodiment. As shown, a cleaning blade 110 adjoins the contact roller 2 and has one or free edge thereof contacting the surface of the roller 2 for removing the carrier Tc transferred from the paper P. With the cleaning blade 110, the fixing device 1 is capable of fully removing the carrier Tc from the contact roller 2 and thereby further promoting stable fixation, and in addition efficiently removing the needless carrier Tc from the toner image T.

Figure 11:
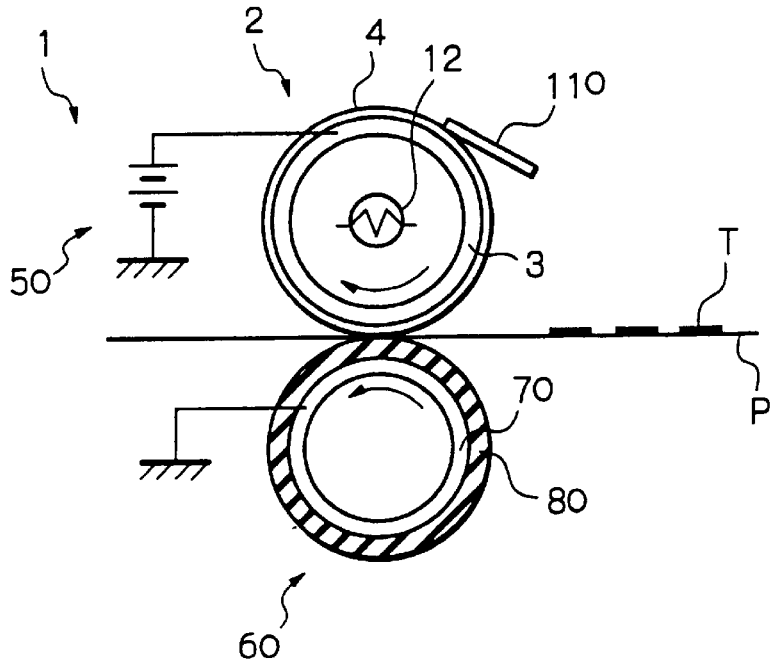

FIG. 11 shows a second modification of the illustrative embodiment. As shown, a halogen lamp or heat source 120 is disposed in the contact roller 2, as in the first embodiment. During fixation, the halogen lamp 120 is turned on to heat the surface layer of the contact roller or heat roller 2 to a temperature between 40° C. and 100° C. In the second embodiment, the contact roller 2 and press roller 60 simply press the toner image T of the paper P for fixing it. In the case where heat softens or activates the toner particles Tt and thereby intensifies the coupling forces to act between the toner particles Tt and between the toner particles Tt, it is desirable to soften or active the toner particles Tt for further enhancing the fixing ability.

Heating the heat roller 2 to a surface temperature lower than 100° C. inclusive is successful to reduce the warm-up time and therefore power consumption. Moreover, such a surface temperature of the heat roller 2 allows a minimum of water content of the paper P, which is a specific form of a recording medium, to be lost and thereby minimizes the creasing and curling of the paper P as well as variation in, e.g., electrical resistivity. This is particularly effective when the first toner image formed on one side of the paper P in a duplex mode is fixed.

Further, heating the heat roller 2 to a surface temperature higher than 40° C. inclusive is successful to set the surface temperature of the heat roller 2 without resorting to cooling means. The fixing device 1 is therefore simplified in construction and easily maintains the surface temperature of the heat roller 2.

When the toner Tt contains resin having a glass transition point around 50° C. and a melting point around 90° C., extremely efficient fixation is attainable by maintaining the surface temperature of the heat roller 2 at about 70° C., as experimentally determined.

Figure 12:
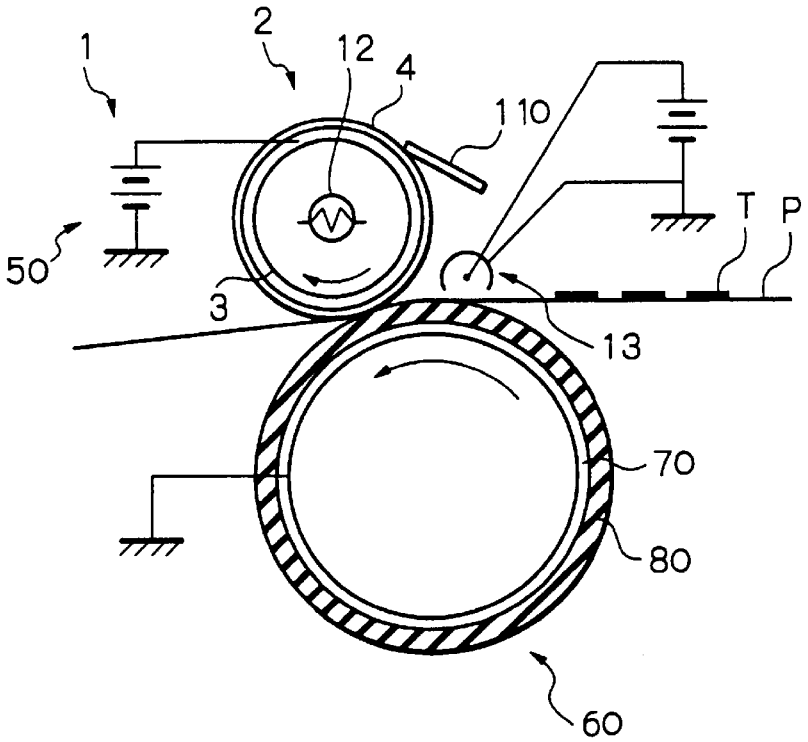

FIG. 12 shows a third modification of the illustrative embodiment. In the illustrative embodiment, it sometimes occurs that the toner Tt dispersed in the carrier Tc and forming the toner image T on the paper P loses substantial part of its charge before reaching the fixing position. In light of this, the third modification additionally includes a corona charger or similar charge depositing means 13 adjoining the nip between the heat roller 2 and the press roller 60. In this configuration, just before the toner image T on the paper P reaches the nip, the corona charger 13 radiates ions of true charge (positive charge) onto the toner image T. The charge is partly released via the carrier Tc and paper P, but partly held by the toner Tt for a moment. The paper P is passed through the nip before the charge held by the toner Tt is entirely released via the carrier Tc. Consequently, even when the charge held by the toner Tt in the carrier Tc is short, it is possible to sufficiently fix the toner image T on the paper P.

The above charge depositing means promotes not only the fixation of an image formed by a developing liquid customarily used for electrophotography and consisting of toner capable of temporarily holding a charge and carrier, but also the fixation of an image formed by ink or similar coloring liquid containing toner and carrier.

Figure 13:
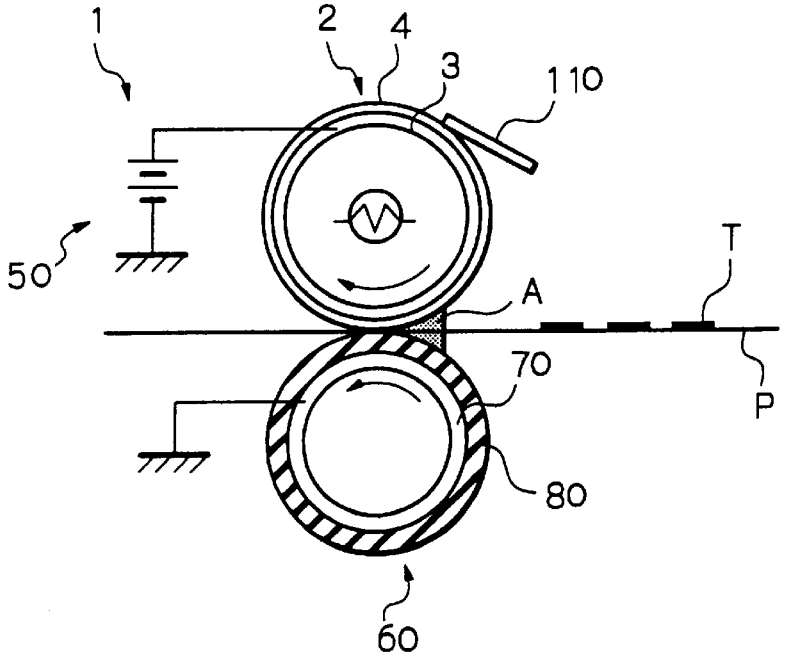

FIG. 13 shows a fourth modification of the illustrative embodiment. In the third modification, the corona charger 13 is used to cause the toner Tc to hold a charge. By contrast, in FIG. 13, the bias voltage to be applied to the heat roller 2 is controlled by using the electrical resistance characteristic of the anode oxide film 4 formed on the aluminum roller 3. This allows a charge to be deposited on the paper P from the surface of the heat roller 2 in the stable discharge region A just before the paper P enters the nip.

Figure 14:
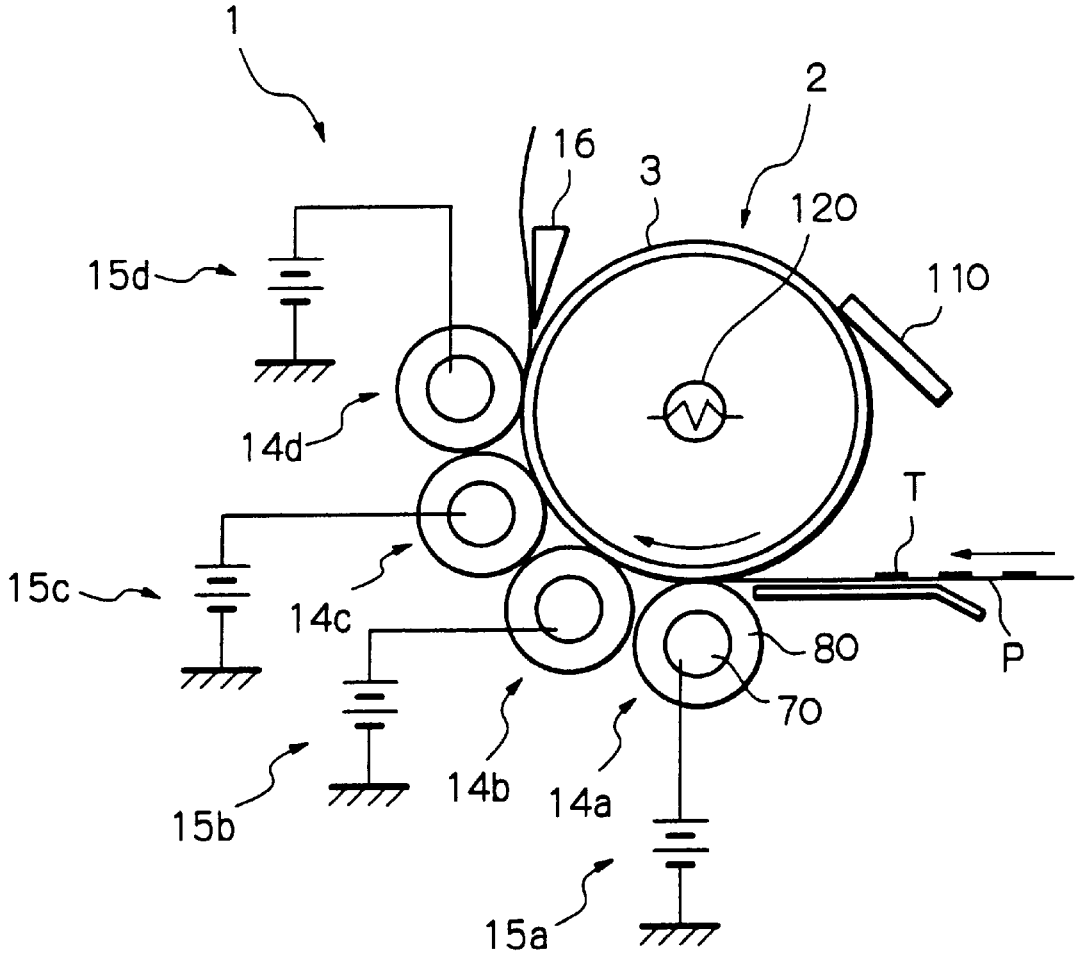

FIG. 14 shows a fifth modification of the illustrative embodiment. In the illustrative embodiment and its first to fourth modifications, the pressing mechanism uses the heat roller or contact roller 2 and press roller 60 in order to simplify the construction. This kind of pressing mechanism, however, reduces the duration of contact of the paper P and heat roller 2. As a result, when the halogen lamp 120 is disposed in the heat roller 2, as in the second modification, heat sufficient to implement desirable fixation is sometimes unattainable.

In light of the above, as shown in FIG. 14, the fifth modification includes a plurality of pressing members in the form of backup rollers 14*a*, 14*b*, 14*c* and 14*d* contacting the heat roller 2. Constant current power sources 15*a*, 15*b*, 15*c* and 15*d* are connected to the backup rollers 14*a*–14*d*, respectively. In this modification, the heat roller 2 is not connected to the previously stated bias power source 50, but is connected to ground. The constant current power sources 15*a*–15*d* each are configured to set up a potential difference for causing discharge to occur between the associated backup roller and the heat roller 2. While the discharge should preferably be glow discharge from the stability standpoint, it may even be corona discharge or similar discharge. A peeler 16 for peeling the paper P from the heat roller 2 is positioned at the outlet of a fixing range defined between the backup rollers 14*a*–14*d* and the heat roller 2.

In operation, the constant current power sources 15*a*–15*d* each apply a bias voltage to the metallic roller 70 of the associated one of the backup rollers 14*a*–14*d*. As a result, the surface potential of each of the backup rollers 14*a*–14*d* becomes lower than the surface potential of the heat roller 2, producing a potential difference greater than a discharge start voltage between the backup rollers 14*a*–14*d* and the heat roller 2. When the paper P with the toner image T is brought to the fixing station, the heat roller 2 presses the surface of the paper P carrying the image T while the backup rollers 14*a*–14*d* press the other surface of the paper P. In this condition, the paper P is conveyed in the fixing range.

While the paper P is conveyed in the fixing range, the potential difference between the heat roller 2 and each of the backup rollers 14*a*–14*d* causes a discharge current to flow to the toner image T not only at the position where the image T contacts the heat roller 2, but also at both sides of such a position. Consequently, the positively charged toner Tt coheres on the paper P and adheres to the paper P. The toner Tt cohered and adhered to the paper P forces out most of the carrier Tc toward the heat roller 2 and causes it to form a carrier layer Tc. The other part of the carrier Tc is absorbed in the paper P.

The paper P being conveyed in the fixing range is pressed between the heat roller 2 and the backup rollers 14*a*–14*d*. At this instant, the heat roller 2 contacting the paper P heats the paper P with the halogen lamp 120. The backup rollers 14*a*–14*d* allow the heat roller 2 to heat the paper P over a longer period of time than the single press roller 80 of any one of the illustrative embodiment and its previous modifications. This lowers the fixing temperature required of the heat roller 2.

Of course, the four backup rollers 14*a*–14*d* are only illustrative and may be replaced with any other suitable number of backup rollers matching with a paper conveying speed, the kind of toner and other conditions.

By the above procedure, strong coupling forces act between the particles of the toner Tt and between the particles and the paper P, thereby fixing the toner image T on the paper P. The peeler 16 peels off the paper O with the fixed toner image T from the heat roller 2.

An example of the fifth modification will be described specifically. The heat roller 2 was implemented by a tubular aluminum core having a wall thickness of 1 mm and an outside diameter of 40 mm. The surface of the aluminum core was subjected to anode oxidation to form a 30 $\mu$m thick anode oxide film. The pores of the anode oxide film were sealed. The backup rollers 14*a*–14*d* each were implemented by a metallic core covered with an elastic rubber layer and had a diameter of 14 mm. The elastic rubber layer was about 3 mm thick and implemented by EPDM having a volume resistivity of $10^6$ Ω.cm to $10^8$ Ω.cm. The heat roller 2 and backup rollers 14*a*–14*d* each had an axial length of 0.32 m.

The heat roller 2 was heated to a surface temperature of 85° C. which is between the glass transition point Tg and the melting point Tm of the toner particles. The paper P was conveyed at a rate of 500 mm/sec. Fixation was repeated by varying the currents to be fed from the constant current power sources 15*a*–15*d* to the backup rollers 14*a*–14*d*. Sufficient fixation was achieved when each current was greater than 300 $\mu$A inclusive in absolute value, i.e., the total current applied to the four backup rollers 14*a*–14*d* was greater than 1,200 $\mu$A inclusive in absolute value.

A series of experiments showed that for sufficient fixation it is necessary to cause a discharge current to flow to the toner image T of the paper P on the basis of discharge between the heat roller 2 and the paper P. Particularly, to insure uniform fixation over the entire toner image T, it is necessary to cause the discharge current to flow to the toner image T in a stable manner. The prerequisite for stable discharge is that a value produced by differentiating the potential difference between the heat roller or electrode 2 and each of the backup rollers 14*a*–14*d* by the current (current differentiated value hereinafter) be adequate. The current differentiated value is likely to vary due to the temperature variation and deterioration of the heat roller 2 and backup rollers 14*a*–14*d*, rendering the discharge currents flowing between the rollers 2 and 14*a*–14*d* unstable. This example insures the stable flow of the discharge currents by controlling the discharge currents on the basis of constant current control.

Experimental results indicated that when the above current differentiated value for a unit length of each of the rollers 2 and 14*a*–14*d* ranged from $1\times10^{-7}$ $A.V^{-1}.m^{-1}$ to $1\times10^{-4}$ $A.V^{-1}.m^{-1}$, stable discharge occurred without any overcurrent ascribable to local leak.

Figure 15:
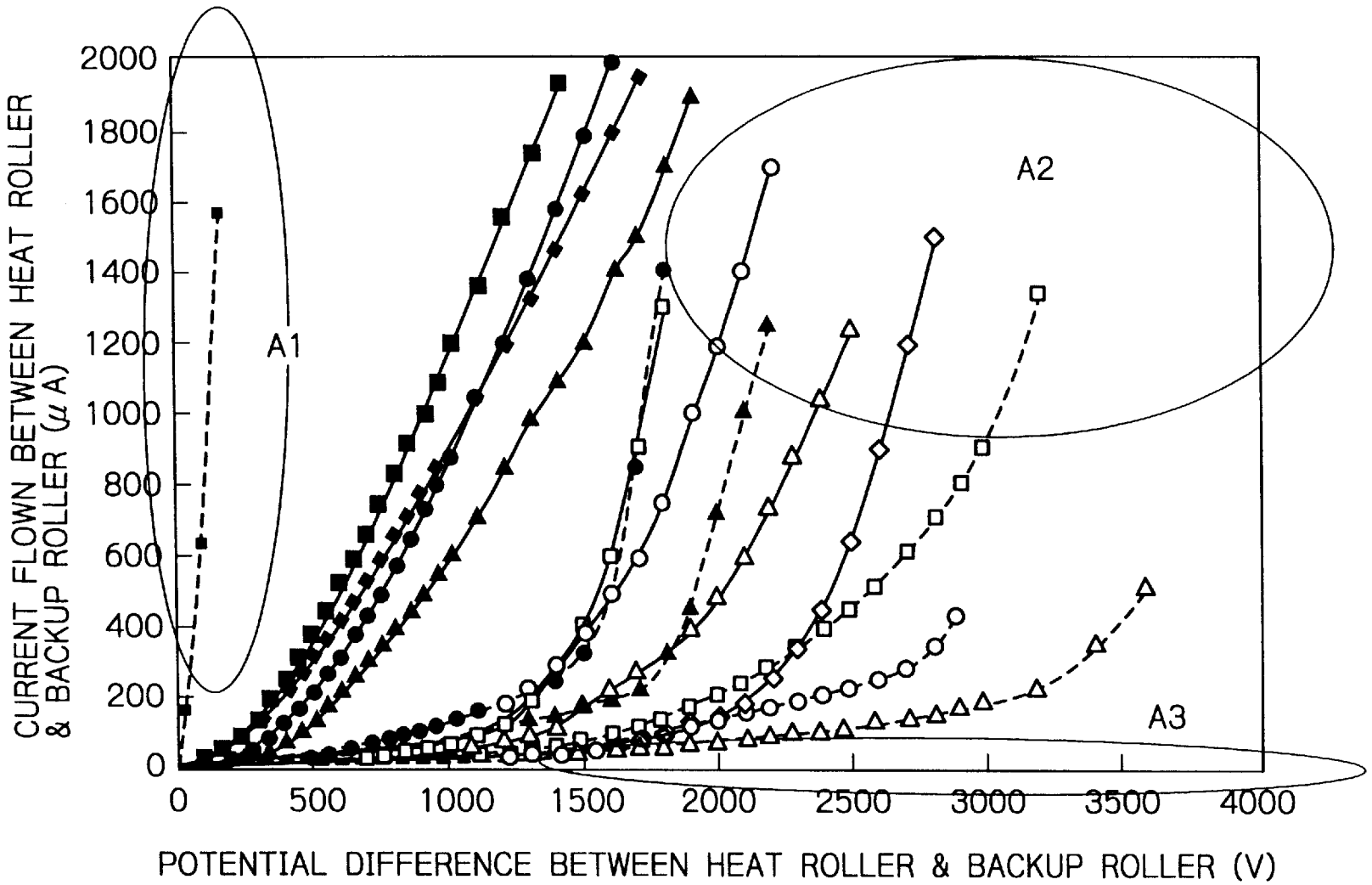
FIGS. 15 and 16 are graphs each showing measured current-voltage characteristics between the heat roller and a backup roller.

FIG. 15 is a graph showing part of current-voltage characteristics between the heat roller 2 and the backup rollers 14*a*–14*d* experimentally measured by varying the materials forming the surfaces of the rollers 2 and 14*a*–14*d*. When the material forming the surface of the heat roller 2 or the material forming the surface of each of the backup rollers 14*a*–14*d* has an extremely low resistance, the current differentiated value, i.e., a slope shown in FIG. 15, is great. More specifically, in the fixing device belonging to an area A1 of FIG. 15, the heat roller 2 having an extremely low resistance makes it difficult to set up, when the paper P is conveyed in the fixing range, a great potential difference necessary for discharge to occur between the surface of the heat roller 2 and that of the paper P. This reduces the discharge current and thereby obstructs sufficient fixation. On the other hand, the backup rollers 14*a*–14*d* each having an extremely low resistance cause an overcurrent to flow due to local leak and thereby obstructs stable discharge.

The above problems can be solved if the current differentiated value is selected to be at least smaller than $1\times10^{-4}$ $A.V^{-1}.m^{-1}$ inclusive so as to obviate an overcurrent ascribable to local leak. Consequently, uniform discharge currents can flow to the toner image T stably, insuring uniform fixation. In addition, the surfaces of the rollers 2 and 14*a*–14*d* are free from damage ascribable to the overcurrent.

Assume that the potential difference between the heat roller 2 and any one of the backup rollers 14*a*–14*d* is small. Then, even if the current differentiated value is less than $1\times10^{-4}$ $A.V^{-1}.m^{-1}$ inclusive, it sometimes sharply increases with an increase in the above potential difference because the resistance of the surface layer of the roller lacks linearity, as indicated by an area A2 in FIG. 15. Even in such a condition, so long as the current differentiated value is less than $1\times10^{-4}$ $A.V^{-1}.m^{-1}$ inclusive, stable discharge is guaranteed to obviate local leak and therefore overcurrents.

When the material forming the surface layer of the heat roller 2 or the material forming the surface of each of the backup rollers 14*a*–14*d* has an extremely high resistance, the current differentiated value is small. More specifically, in the fixing device belonging to an area A3 of FIG. 15, the heat roller 2 having an extremely high resistance is apt to cause the paper P moved away from the fixing range to electrostatically adhere to the heat roller 2, making it difficult to peel off the paper P. This occurrence is successfully obviated if the current differentiated value is at least greater than $1\times10^{7}$ $A.V^{-1}.m^{-1}$ inclusive. The backup rollers 14*a*–14*d* having an extremely high resistance each must be applied with a voltage high enough to guarantee the current for fixation. This is apt to damage the material forming the surfaces of the rollers 14*a*–14*d*. Such an occurrence is also obviated if the current differentiated value is at least greater than $1\times10^{7}$ $A.V^{-1}.m^{-1}$ inclusive.

A sixth modification of the illustrative embodiment will be described hereinafter. In the above fifth embodiment, the constant current power sources 15*a*–15*d* are assigned one-to-one to the backup rollers 14*a*–14*d*. In this condition, discharge to occur between the heat roller 2 and the backup rollers located at the downstream side in the direction in which the paper P is conveyed (direction of conveyance hereinafter) does not make noticeable contribution. In the sixth embodiment, the constant current power source 15*a* is connected only to the backup roller 14*a* located at the most upstream side in the above direction while the other three backup rollers 14*b*–14*d* are held in an electrically floating state. Even this kind of configuration is successful to cause discharge to occur before heating the toner image T on the paper P, so that the toner Tt efficiently coheres before being melted and can therefore be effectively fixed on the paper P.

An example of the sixth modification is as follows. The example is identical with the example of the fifth embodiment except that the upstream backup roller 14*a* is connected to the constant current power source 15*a* while the other backup rollers 14*b*–14*d* are held in an electrically floating state. Four different fixing devices each having four backup rollers 14*a*–14*d* were prepared for determining their current-voltage characteristics. The four backup rollers 14*a*–14*d* of each fixing device were different in material from the backup rollers 14*a*–14*d* of the other fixing devices.

Figure 16:
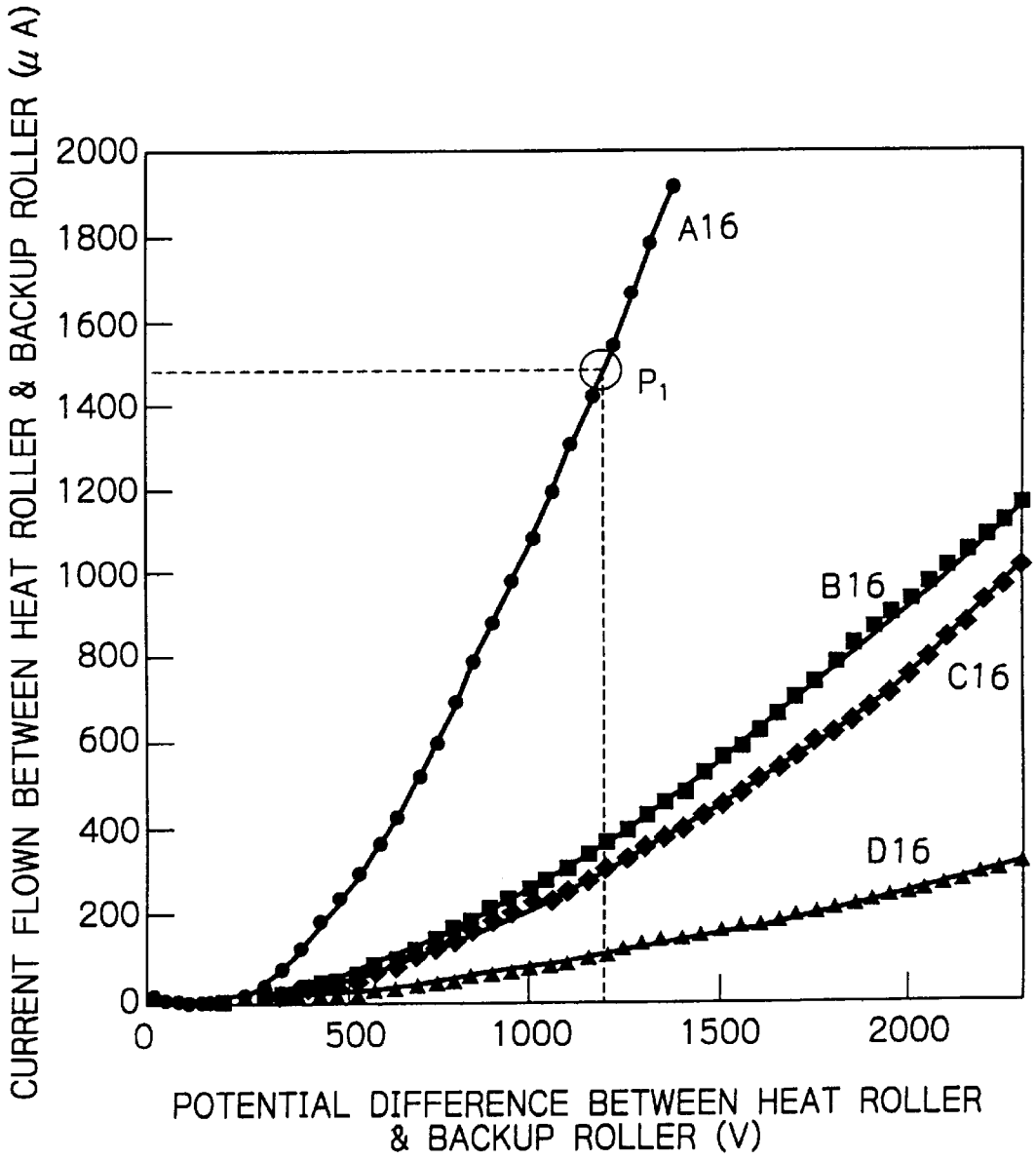

FIG. 16 shows curves A16, B16, C16 and D16 each being representative of a relation between the current to flow between the heat roller 2 and the backup roller 14*a* of a particular fixing device and the potential difference between the two rollers 2 and 14*a*. As shown, each fixing device has a particular current-voltage characteristic. Sufficient fixation was achieved when the current was above a point $P_1$, i.e., when the current fed from the constant current power source 15*a* was above about 1,500 $\mu$A inclusive in absolute value. When the paper P was absent and when the heat roller 2 was warmed up to 85° C., the current differentiated value, i.e., the slope at the point $P_1$ was about $2.86\times10^{-6}$ A/V while the current differentiated value for a unit length was $8.94\times10^{-6}$ $A.V^{-1}.m^{-1}$.

In the fifth and sixth modifications, the paper P holds a charge due to the discharge and is apt to electrostatically adhere to the heat roller 2 when it moves away from the fixing range. In light of this, the backup roller 14*d* located at the most downstream side in the direction of conveyance is connected to ground. This causes the charge of the paper P to be released to ground and thereby reduces electrostatic adhesion acting between the paper P and the heat roller 2. Consequently, the paper P can be surely separated from the heat roller 2.

It is noteworthy that in the second embodiment and its modifications the high resistance, anode oxide film 4 forming the surface of the aluminum roller 3 and resistant to structural destruction allows a great current to flow between the heat roller 2 and the press roller 60. Such a current realizes rapid fixation of the toner image T on the paper P.

While the second embodiment and its modifications each use an about several ten microns thick anode oxide film as a thin high resistance film formed on the heat roller 2, the thin film may alternatively be implemented by fluorocarbon resin whose electrical resistivity is about $10^{10}$ Ω.cm or above.

As stated above, the second embodiment and its modifications have the following various unprecedented advantages.

(1) Coupling forces acting between toner particles, or fine colored particles, and between the toner particles and a paper or similar recording medium are intensified during a single fixing step. This realizes a compact fixing device capable of fixing a toner image without disturbing it at all. Particularly, a current flowing between the surface of a contact member and that of a pressing member allows the toner particles to strongly cohere and firmly adhere to the paper and thereby insures an attractive fixed image, compared to a simple electric field.

(2) The toner image is fixed on the paper with a solvent or carrier layer intervening between the contact member and the toner particles. The carrier layer causes a minimum of deposition of the toner particles on the contact member to occur and thereby obviates offset and disturbance to an image ascribable to offset. In addition, the surface layer of the contact member does not have to be formed of a special material having a high parting ability, i.e., a broad range of materials are applicable to the surface layer.

(3) Even when the potential difference between the surface of the contact member and that of the pressing member varies due to temperature, humidity and other environmental factors or the material of the contact member and that of the pressing member, a constant current power source is capable of causing a stable current to flow and thereby insuring uniform fixation.

(4) Even the toner particles existing in the solvent and short of charge can hold a charge due to the positive application of a charge based on discharge. This also implements a compact configuration and frees the fixed image from disturbance.

(5) The heated contact member softens or activates the toner particles during a single fixing step and further increases the coupling forces acting between the toner particles and between the toner particles and the paper. This also achieves the above advantage (4).

(6) The surface of the contact member is heated to above 40° C. inclusive, but below 100° C. inclusive; this range lies between the glass transition point and the melting point of the toner particles. The surface temperature is therefore close to room temperature, i.e., the toner image can be fixed by pressure at a temperature close to room temperature. This not only reduces the warm-up time, but also saves power. Further, such a temperature allows a minimum of water contained in the paper from evaporating and therefore frees the paper from creases, curls and decreases in electrical resistivity. Moreover, the contact member does not have to be cooled off. Stated another way, only heating means for maintaining the surface of the contact member at a preselected temperature is needed. This facilitates the temperature adjustment of the contact member, compared to the conventional scheme using both of cooling means and heating means.

(7) When a plurality of pressing members are held in contact with the contact member, the contact member and the image surface of the paper contact each other over a longer period of time, i.e., the image surface is heated over a longer period of time. This brings the surface temperature required of the contact member closer to room temperature.

(8) Discharge occurring before the toner on the paper is melted by heat allows the toner to efficiently cohere together.

(9) After fixation, the charge held by the paper is dissipated in order to reduce electrostatic adhesion acting between the paper and the contact member. This is successful to enhance the separation of the paper from the contact member.

(10) The current differentiated value of the potential difference between the surface of the contact member and that of the pressing member is selected to be greater than $1\times10^{-7}$ $A.V^{-1}.m^{-1}$ inclusive under preselected conditions. This also promotes the separation of the paper from the surface of the contact member while protecting the pressing member from damage. Further, the current differentiated value is selected to be less than $1\times10^{-4}$ $A.V^{-1}.m^{-1}$ inclusive so as to promote the discharge between the contact member and the paper.

(11) A cleaning member removes the solvent deposited on the contact member and therefore allows the contact member to efficiently remove the excessive solvent from the toner image. Consequently, sufficient fixation is effected in a stable manner.

(12) The surface layer of the contact member is formed of a high resistance layer resistant to currents and therefore structural destruction. This allows a necessary potential difference to be surely set up between the contact member and the pressing member and allows a necessary current to flow more uniformly and more stably, thereby further obviating disturbance to the toner image.

(13) The contact member and pressing member with a simple configuration form a nip therebetween. An electric field, heat and pressure can be stably applied to the nip and free the fixed image from disturbance.

Third Embodiment

Figure 17:
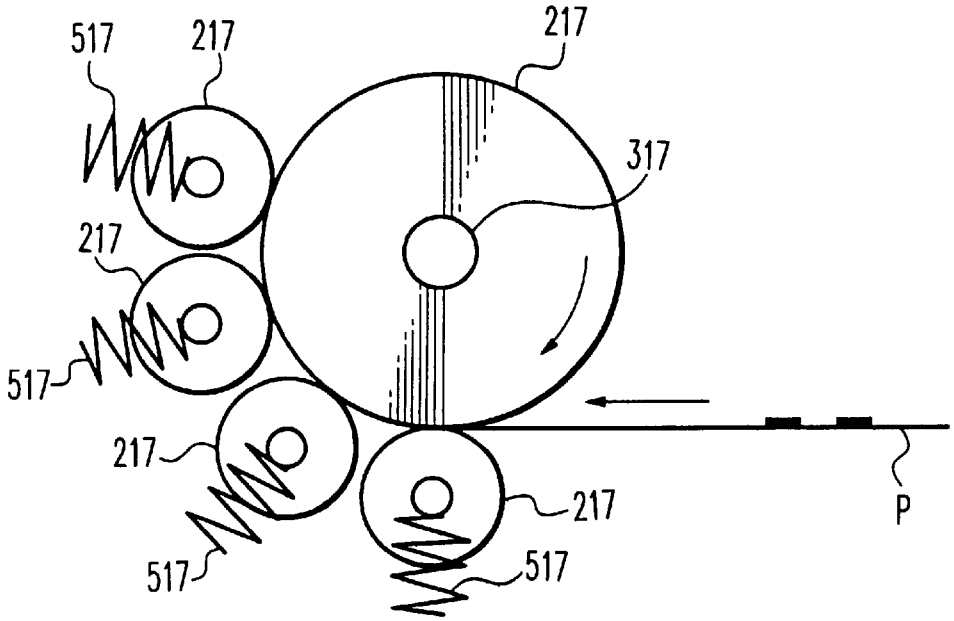
FIG. 17 is a side elevation showing a third embodiment of the image fixing device in accordance with the present invention.

Referring to FIG. 17, a third embodiment of the present invention includes a heat roller 117, a drive motor, not shown, for driving the heat roller 117, and four backup rollers 217 sequentially arranged in the circumferential direction of the heat roller 117. The heat roller 117 is made up of a hollow cylindrical core and a fluorocarbon resin layer formed on the outer periphery of the core by coating. The fluorocarbon may be implemented by, e.g., PFA (tetrafluoroethylene-perfluoroalkylvinyl copolyer) or PTFE (polytetrafluoroethylene). A halogen lamp or heat source 317 is disposed in the heat roller 117. A power feed control device, not shown, controls power to be fed to the halogen lamp 317 such that the surface of the heat roller 117 remains at a preselected temperature. While the heat roller 117 has an outside diameter D, the backup rollers 217 each have an outside diameter d which is ⅖ of the diameter D. The surface of each backup roller 217, like the surface of the heat roller 117, is coated with fluorocarbon resin.

Because the ratio of the outside diameter of each backup roller 217 to the outside diameter D of the heat roller 117 is 0.4, it is possible to arrange four backup rollers 217 within a limited range along the circumference of the heat roller 117. Further, the backup rollers 217 are positioned close enough to stably convey a paper or similar recording medium P in a fixing range extending along the circumference of the heat roller 117.

Spring members or biasing means 5 are respectively anchored to axially opposite ends of each backup roller 217 and constantly bias the backup rollers 217 toward the heat roller 117. The spring members 517 are so configured as to press the associated backup roller 217 against the heat roller 117 with a sufficiently weak force. This is successful to cause the paper P to contact the heat roller 117 under a sufficiently low pressure, and therefore to minimize offset. In the fixing range, the paper P is caused to contact the heat roller 117 by the backup rollers 217 at positions where the paper P contacts the backup rollers 217, or by the deformation of the paper P itself at the other positions. The paper P can therefore closely contact the heat roller 117 over the entire fixing range and therefore over a long period of time.

In the illustrative embodiment, each backup roller 217 presses the paper P against the heat roller 117 with a force of less than 50 g/cm inclusive for a unit length of the backup roller 217.

Figure 18:
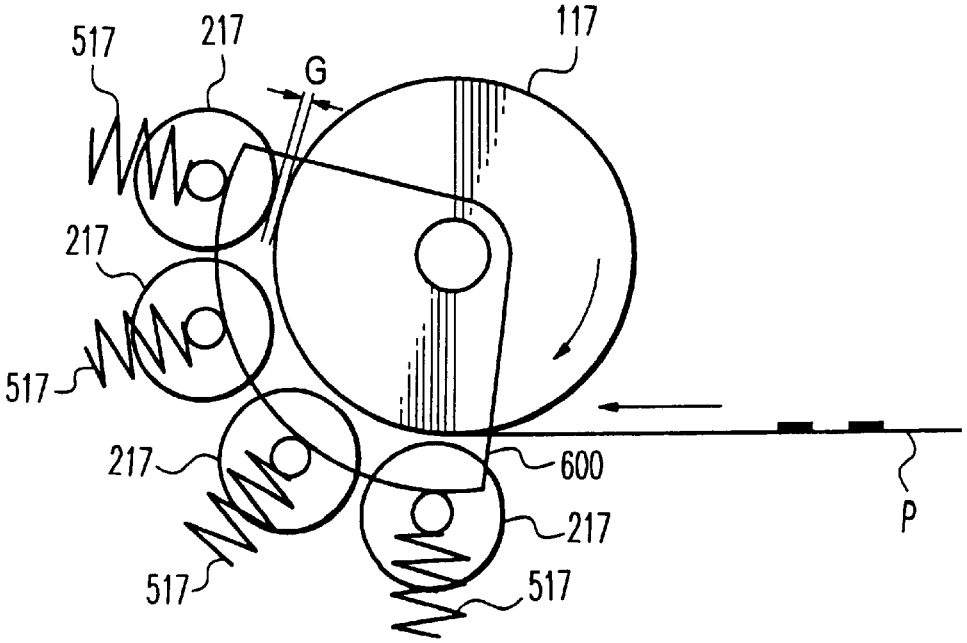
FIG. 18 is a side elevation showing a modification of the third embodiment.

FIG. 18 shows a modification of the third embodiment. The modification is identical with the third embodiment except for the following. In the modification, the shaft of the heat roller 117 and the shafts of the backup rollers 217 each protrude from axially opposite ends of the roller. As shown in FIG. 18, two stops 600 (only one is visible) in the form of sector plates respectively intervene between the opposite ends of the shaft of the heat roller 117 and the opposite ends of the shafts of the backup rollers 217. Specifically, each stop 600 includes an acute angle portion affixed to one end of the shaft of the heat roller 117 and an arcuate portion supported by the ends of the backup rollers 217. In this configuration, while the spring members 5 bias the backup rollers 217 toward the heat roller 117, the stops 600 limit the movement of the backup rollers 217 and hold each of them at a preselected position. As a result, a gap G is formed between the surface of the heat roller 117 and the surfaces of the backup rollers 217. In the modification, the gap G is selected to be about 100 $\mu$m.

Figure 19A:
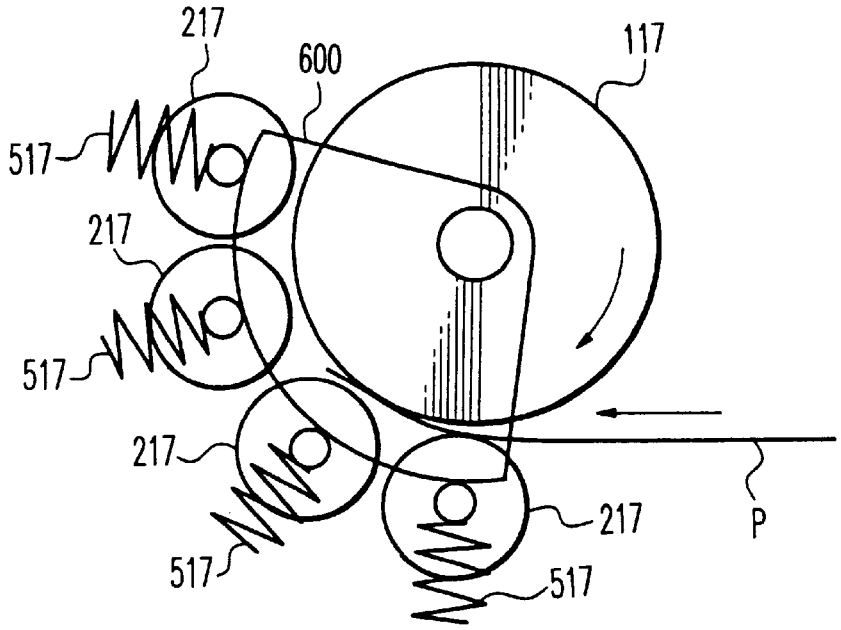
FIGS. 19A and 19B are side elevations showing how a paper is conveyed in the modification of FIG. 18.
Figure 19B:
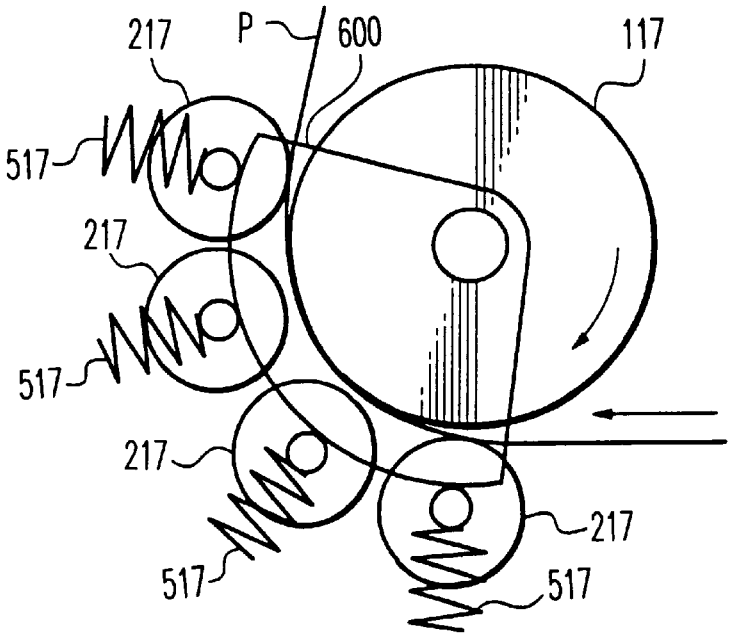

The operation of the above modification will be described on the assumption that the paper P carrying a toner image thereon is less than 100 $\mu$m thick. FIG. 19A shows a condition wherein the leading edge of the paper P is positioned in the fixing range while FIG. 19B shows a condition wherein it has moved away from the fixing range. As shown, the backup rollers 217 sequentially convey the paper P while steering it along the circumference of the heat roller 117. Therefore, the portion of the paper P existing in the fixing range is curved and closely contacts the heat roller 117. Because the paper P is heated by the heat roller 117 with hardly any pressure acting thereon, the offset of the toner is minimized. Further, heat is efficiently transferred from the heat roller 117 to the paper P closely contacting the heat roller 117, insuring efficient fixation. In addition, an adhesion force acting between the carrier or solvent on the paper P and the heat roller 117 due to the close contact is coupled with the shear stress of the carrier to insure the conveyance of the paper P.

Even when the paper P carrying the toner image is thicker than 100 μm, the gap G allows the spring members 517 to have a shorter stroke than the springs members 517 of the third embodiment and therefore allows the contact pressure between the paper P and the heat roller 117 to be further reduced.

Moreover, the heat roller 117 and backup rollers 217 are fully spaced from each other when fixation is not under way. It follows that when the halogen lamp 3 heats the heat roller 117 during warm-up, the heat of the heat roller 117 is prevented from being transferred to the backup rollers 217. This not only reduces the warm-up time of the heat roller 117, but also saves power.

Figure 20:
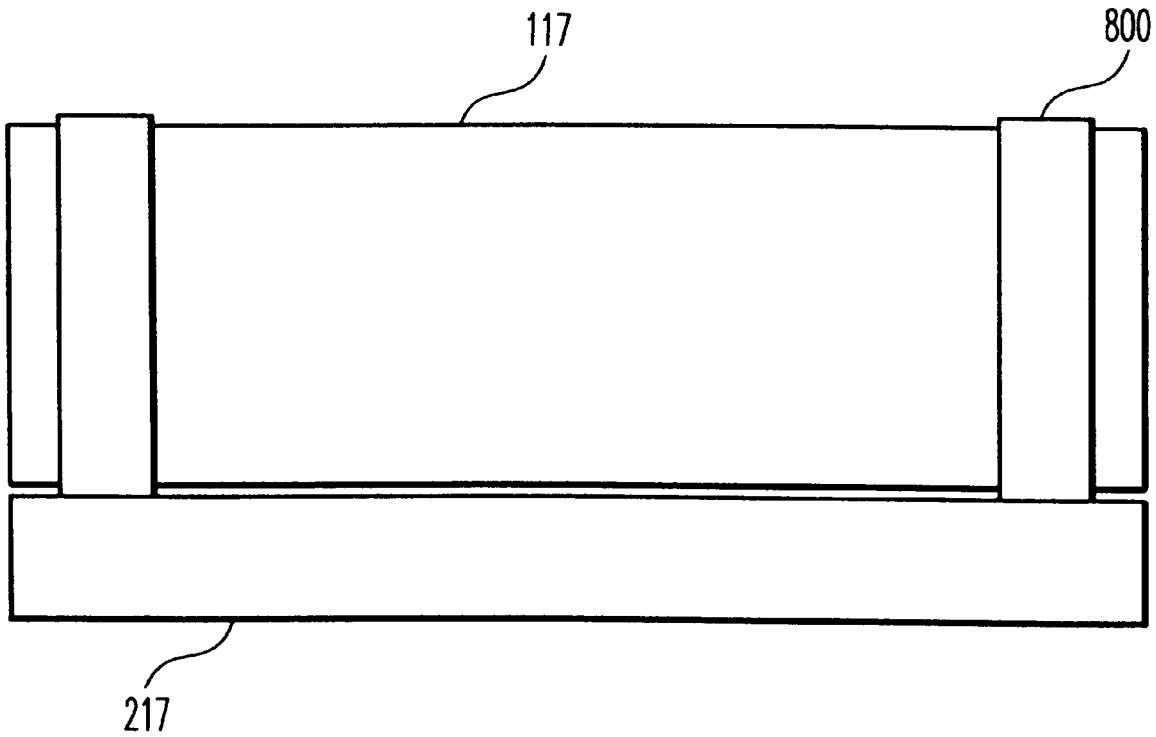
FIG. 20 is a front view showing a specific gap forming mechanism included in the modification of FIG. 18.

FIG. 20 shows another specific configuration of the mechanism for forming the gap G between the heat roller 117 and the backup rollers 217. As shown, the heat roller 117 is formed with circumferential ridges 800 in the vicinity of axially opposite ends thereof. The ridges 800 have a greater diameter than the other portion or fixing portion of the heat roller 117. To form the ridges 800, the opposite end portions of the heat roller 117 are coated to a greater thickness than the fixing portion during fluorocarbon resin coating. Alternatively, the heat roller 117 may be entirely coated with fluorocarbon resin to a slightly greater thickness and have its intermediate fixing portion machined to form the ridges 800.

To reduce the warm-up time of the heat roller 117, it is necessary to reduce the heat capacity of the roller 117 to a sufficient degree. This can be effectively done if the wall thickness of the heat roller 117 is reduced. However, the true circularity of the heat roller 117 decreases with a decrease in wall thickness. A decrease in true circularity would render the contact pressure between the heat roller 117 and the paper P irregular in the circumferential direction of the roller 117; local offset would occur at portions where the contact pressure is high. In addition, the irregular contact pressure would obstruct heat transfer at the positions where the paper P is spaced from the heat roller 117 and would thereby deteriorate fixation.

In the specific configuration shown in FIG. 20, the gap is formed by the ridges 800 of the heat roller 117 abutting against the backup rollers 217. The gap can therefore be maintained constant even when the true circularity of the heat roller 117 is low. Moreover, a minimum of heat is transferred from the heat roller 117 to the backup roller 217 because only the ridges 800 contact the backup rollers 217.

In the third embodiment and its modification, a drive motor or backup roller drive means, not shown, may be used to cause the backup rollers 217 to rotate. Such a drive motor, coupled with the drive motor assigned to the heat roller 117, will insure the smooth, stable conveyance of the paper P. Alternatively, the rotation of the heat roller 117 may be transferred to the backup rollers 217 via gears mounted on the opposite ends of the heat roller 117 and those of the backup rollers 217 and held in mesh with each other.

An example of the third embodiment will be described hereinafter. The heat roller 117 is implemented by a hollow aluminum tube having a thickness of 700 μm and an outside diameter D of 30 mm and coated with 30 μm thick fluorocarbon resin. Each backup roller 217 is formed of stainless steel and coated with fluorocarbon resin in such a manner as to have an outside diameter of 12 mm. The ratio of the outside diameter to the outside diameter D is therefore 0.4. The heat roller 117 and backup rollers 217 each are 320 mm long in the axial direction. The spring members 5 press the backup rollers 217 against the heat roller 117 with a force of 1,000 gf.

The above example was found to desirably fix toner images on various kinds of papers generally used in the printing field, e.g., thin coated papers for advertisements and thick uncoated papers for name cards.

Two different kinds of experiments were conducted by varying the gap G between the heat roller 117 and the backup rollers 217, as follows.

Figure 21:
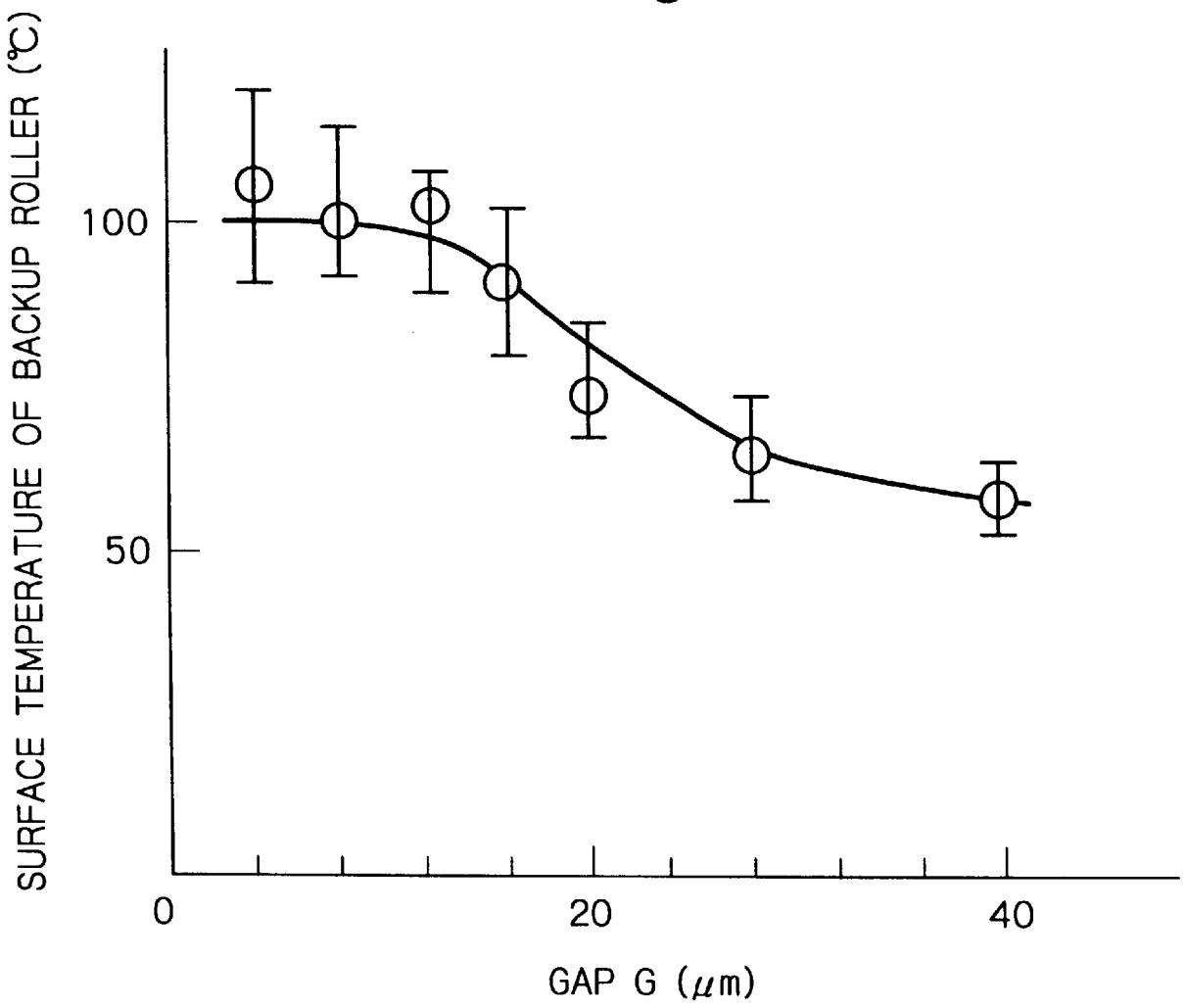
FIG. 21 is a graph showing a relation between the size of a gap included in the third embodiment and the surface temperature of the backup roller.

First, a relation between the gap G and the surface temperature of the backup rollers 217 was measured. Specifically, the heat roller 117 was heated to 140° C. and rotated together with the backup rollers 217 for a preselected period of time. The surface temperature of each backup roller 217 was measured at a single point for gaps G of less than 40 μm. The results of measurement are plotted in FIG. 21. As shown, when the gap G is less than 20 μm, the surface temperature of the backup roller 217 is extremely high. This is presumably because the heat roller 117 and backup roller 217 locally contact each other due to short mechanical accuracy. It follows that the gap G should be greater than 20 μm inclusive in order to reduce the amount of needless heat.

Figure 22:
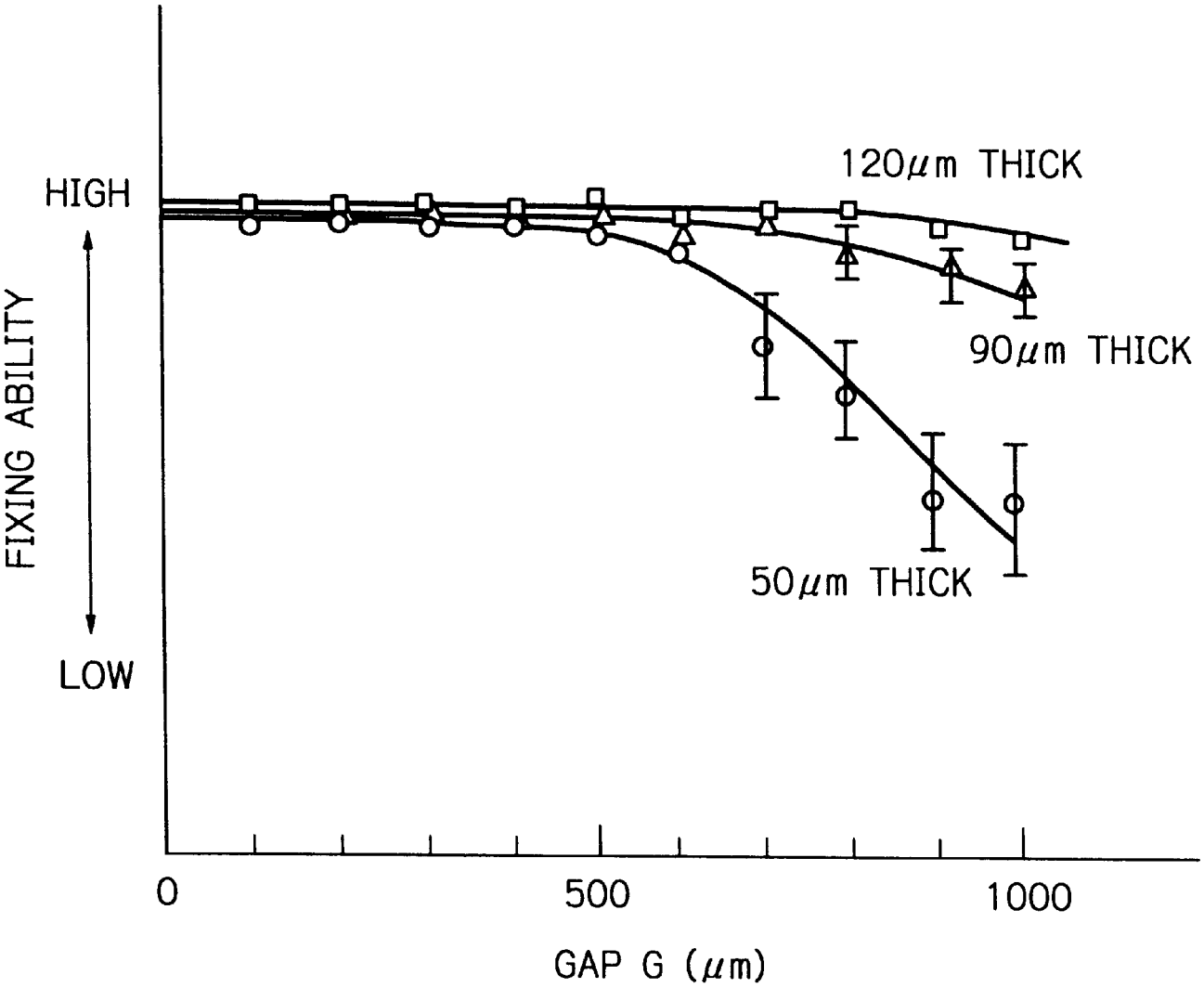
FIG. 22 is a graph showing a relation between the size of the gap and the degree of fixation.

Second, a relation between the gap G and the degree of fixation of the toner image on the paper was determined. FIG. 22 shows the results of measurement conducted with 50 μm, 90 μm and 120 μm thick papers P of the same quality and a gap G of less than 1 mm inclusive. As shown, fixation is more deteriorated as the gap G increases. Particularly, when the gap G is greater than 500 μm, fixation is noticeably deteriorated. Presumably, the noticeable deterioration is ascribable to insufficient contact of the paper P with the heat roller 117. The conveyance of the paper P is also deteriorated due to the deterioration of fixation. Therefore, to stably fix toner images without regard to the kind of the paper P, the gap G should be less than 500 μm inclusive. The upper limit of the gap G presumably depends on, e.g., the kind (e.g. hardness) of the paper P and the outside diameter of the heat roller 117 to some degree.

As stated above, the third embodiment and its modification each implements a simple, small size fixing device capable of reducing the amount of offset, enhancing efficient heat transfer, insuring desirable fixation, and reducing the warm-up time. More specific advantages achievable with the embodiment and its modification are as follows.

(1) Backup rollers are substituted for a press roller included in a heat roller type fixing system and reduce the overall height of the fixing device. The fixing device with the backup rollers is far simpler in construction than a fixing device using a heat belt or a heat film. The backup rollers mainly form a path for conveying a recording medium while guiding it. In this sense, the backup rollers differ from the heat roller which presses a recording medium for fixing a toner image.

(2) The backup rollers each exert a pressure of less than 50 g/cm for a unit length. This allows the recording medium to contact the heat roller under a sufficiently low pressure and thereby reduces the amount of offset. Even such a low pressure guarantees close contact of the recording medium with the heat roller and therefore efficient heat transfer from the heat roller to the recording medium, i.e., efficient fixation. Particularly, in the case of a color image, the above pressure promotes the coloring of the image.

(3) Because the backup rollers are sequentially arranged along the circumference of the heat roller, they form a heating range broad enough to sufficiently heat a nonvolatile solvent remaining on the recording medium. In the fixing range formed between the heat roller and the backup rollers, the recording medium contacts the heat roller due to the pressure of the backup rollers at positions where it contacts the backup rollers, or by the deformation of the medium itself at the other positions.

(4) Even when one or all of the backup rollers exert a pressure of 0 g/cm, the recording medium can contact the heat roller in the fixing range due to its own deformation because the backup rollers are arranged along the circumference of the heat roller. The deformation of the recording medium insures close contact of the medium and heat roller and promotes efficient heat transfer. Further, such close contact allows an adhesion force acting between the solvent or carrier on the recording medium and the shear stress of the solvent to guarantee desirable conveyance of the medium. It is to be noted that when the pressure of one or all of the backup rollers is 0 g/cm, the fixing device must include conveying means for conveying the recording medium at least until the leading edge of the medium enters the fixing range, i.e., until the medium deforms and contacts the heat roller.

(5) A gap exists between the heat roller and the backup rollers. When the gap is greater than the thickness of the recording medium being conveyed therethrough, i.e., when the pressure of one or all of the backup rollers is 0 g/cm, the contact of the medium with the heat roller is implemented only by the deformation of the medium. The deformation insures close contact of the medium with the heat roller and therefore efficient heat transfer from the former to the latter while guaranteeing the conveyance of the medium. Particularly, the above space prevents heat from being directly transferred from the heat roller to the backup rollers, so that the amount of heat necessary for fixation and warm-up time are reduced.

(6) When the gap is implemented by circumferential ridges formed on opposite end portions of the heat roller, it is not necessary to precisely adjust the arrangement or the pressure of the backup rollers. The gap is therefore easy to form. Generally, because the heat roller is provided with a thin wall thickness in order to reduce its heat capacity, its cross-section is apt to become oval due to the fall of true circularity. Even in such a case, the gap can be maintained constant because it is formed by the backup rollers abutting against the ridges. Further, heat to be transferred from the heat roller to the backup rollers is reduced because the heat roller contacts the backup rollers only with its ridges. Particularly, if the portions of each support roller expected to contact the ridges are formed of a heat insulating material, heat transfer from the heat roller to the backup roller can be further reduced. This is successful to further reduce the warm-up time.

(7) In practice, it is difficult to provide each of the heat roller and backup rollers with true axiality of less than about 10 $\mu$m. Therefore, a gap of at least 20 $\mu$m is necessary for the heat roller and backup rollers to be surely spaced from each other. Such a gap prevents heat from being directly transferred from the heat roller to the backup rollers and thereby reduces the warm-up time. When the gap is greater than 500 $\mu$m, the recording medium fails to closely contact the heat roller. It follows that if the gap is smaller than 500 $\mu$m inclusive, it is possible to guarantee the close contact of the recording medium with the heat roller as well as the conveyance of the medium.

(8) When the gap is greater than the thickness of the recording medium being conveyed therethrough, the contact of the medium with the heat roller is implemented only by the deformation of the medium, as stated earlier. On the other hand, when the above gap is smaller than the thickness of the recording medium, e.g., when the backup rollers are biased by springs, it is possible to reduce the stroke of each spring and therefore to further lower the pressure, compared to the case wherein the gap is absent.

(9) Assume that the heat roller and each backup roller have an outside diameter D and an outside diameter d, respectively. Then, as the ratio of the diameter d to the diameter D, d/D, increases, the transfer of the recording medium from one backup roller to the next backup roller becomes difficult. As a result, the recording medium being conveyed is apt to enter a gap between the adjoining backup rollers. This is particularly true when the recording medium is thin. In light of this, the outside diameter d is selected to be less than or equal to one half of the outside diameter D. The number of backup rollers to be arranged in the fixing range adjoining the heat roller increases with a decrease in the outside diameter of the individual backup roller. Therefore, if the ratio d/D is smaller than or equal to 0.5, a plurality of, preferably three or more, backup rollers can be arranged in the fixing range which is limited for design reasons, guaranteeing stable conveyance of the recording medium.

(10) Because the heat roller and backup rollers both are driven to rotate, the recording medium can be conveyed more stably over the entire fixing range.

Various modifications will become possible for those skilled in the art after receiving the teachings of the present disclosure without departing from the scope thereof.

What is claimed is:

1. A device for fixing an image formed on a recording medium by fine colored particles dispersed in a solvent and capable of at least temporarily holding a charge in said solvent, said device comprising:

a contact member for contacting a first surface of the recording medium carrying the image; and a pressing member for pressing the recording medium against said contact member via a second surface of said recording medium opposite to the first surface to thereby press the image;

said contact member comprising a heat roller made up of a conductive roller serving as a conductive portion, and a high resistance, ceramic thin film formed on a surface of said conductive roller;

said pressing member being formed of an at least semi-conductive material;

wherein a current is caused to flow between said conductive roller and said pressing member via the recording medium.

2. A device as claimed in claim 1, wherein stable discharge is caused to occur between a surface of said heat roller and the first surface of the recording medium via an air layer.

3. A device as claimed in claim 1, wherein said thin film is mainly constituted by aluminum oxide.

4. A device as claimed in claim 1, wherein said heat roller comprises an aluminum roller whose surface layer is subjected to anode oxidation.

5. A device as claimed in claim 1, wherein said thin film is formed on said conductive roller by deposition.

6. A device as claimed in claim 1, wherein said thin film is formed on said conductive roller by flame spraying.

7. A device as claimed in claim 1, wherein said pressing member comprises an at least semiconductive, elastic roller.

8. A device as claimed in claim 1, wherein said pressing member comprises an at least semiconductive, endless belt.

9. A device as claimed in claim 1, wherein a fixing temperature of said heat roller is between a glass transition point and a melting point of the colored particles.

10. A device for fixing an image formed on a recording medium by fine colored particles dispersed in a solvent and capable of at least temporarily holding a charge in said solvent, said device comprising:

a contact member including a high resistance, ceramic thin film on its surface for contacting a first surface of the recording medium carrying the image; and a pressing member for pressing the recording medium against said contact member via a second surface of said recording medium opposite to the first surface to thereby press the image;

wherein a potential difference is set up between a surface of said contact member and a surface of said pressing member via the recording medium.

11. A device as claimed in claim 10, further comprising heating means for heating the surface of said contact member.

12. A device as claimed in claim 11, wherein a surface temperature of said contact member is selected to be higher than 40° C. inclusive, but lower than 100° C. inclusive.

13. A device as claimed in claim 11, wherein said pressing member comprises a plurality of pressing members sequentially arranged in a direction of conveyance in which the recording medium is conveyed, and wherein discharge is caused to occur between a surface of at least one of said plurality of pressing members and the surface of said contact member.

14. A device as claimed in claim 13, wherein the discharge is caused to occur between the surface of at least a most upstream one of said plurality of pressing members in the direction of conveyance and the surface of said contact member.

15. A device as claimed in claim 14, wherein the most downstream one of said plurality of pressing members in the direction of conveyance is connected to ground.

16. A device as claimed in claim 10, further comprising a cleaning member for removing, after the recording medium has been released from said contact member, the solvent deposited on the surface of said contact member.

17. A device as claimed in claim 10, wherein said contact member and said pressing member each are implemented by a roller.

18. A device for fixing an image formed on a recording medium by fine colored particles dispersed in a solvent and capable of at least temporarily holding a charge in said solvent, said device comprising:

a contact member for contacting a first surface of the recording medium carrying the image; and a pressing member for pressing the recording medium against said contact member via a second surface of said recording medium opposite to the first surface to thereby press the image;

wherein a potential difference is set up between a surface of said contact member and a surface of said pressing member via the recording medium, and wherein before the image carried on the recording medium contacts said contact member, discharge is caused to occur between the surface of said contact member and the surface of said pressing member for feeding a charge to the colored particles forming said image.

19. A device for fixing an image formed on a recording medium by fine colored particles dispersed in a solvent and capable of at least temporarily holding a charge in said solvent, said device comprising:

a contact member for contacting a first surface of the recording medium carrying the image; and a pressing member for pressing the recording medium against said contact member via a second surface of said recording medium opposite to the first surface to thereby press the image; and heating means for heating the surface of said contact member;

wherein a potential difference is set up between a surface of said contact member and a surface of said pressing member via the recording medium, and wherein the potential difference above a discharge start voltage is set up between the surface of said contact member and the surface of said pressing member to thereby cause discharge to occur, and wherein when the recording medium is absent and when said contact member is warmed up to a fixing temperature, a value produced by differentiating said potential difference for a unit axial length by a current is selected to be greater than $1\times10^{-7}$ $A.V^{-1}.m^{-1}$ inclusive, but smaller than $1\times10^{-4}$ $A.V^{-1}.m^{-1}$ inclusive.

20. A device for fixing an image formed on a recording medium by fine colored particles dispersed in a solvent and capable of at least temporarily holding a charge in said solvent, said device comprising:

a contact member for contacting a first surface of the recording medium carrying the image; and a pressing member for pressing the recording medium against said contact member via a second surface of said recording medium opposite to the first surface to thereby press the image;

wherein a potential difference is set up between a surface of said contact member and a surface of said pressing member via the recording medium, and wherein an anode oxide film of aluminum is formed on a surface layer of said contact member.

21. A device for fixing an image formed on a recording medium by fine colored particles dispersed in a solvent and capable of at least temporarily holding a charge in said solvent, said device comprising:

a contact member including a high resistance, ceramic thin film on its surface for contacting a first surface of the recording medium carrying the image; and a pressing member for pressing the recording medium against said contact member via a second surface of said recording medium opposite to the first surface to thereby press the image;

wherein a current is caused to flow between a surface of said contact member and a surface of said pressing member via the recording member.

22. A device as claimed in claim 21, further comprising heating means for heating the surface of said contact member.

23. A device as claimed in claim 22, wherein a surface temperature of said contact member is selected to be higher than 40° C. inclusive, but lower than 100° C. inclusive.

24. A device as claimed in claim 22, wherein said pressing member comprises a plurality of pressing members sequentially arranged in a direction of conveyance in which the recording medium is conveyed, and wherein discharge is caused to occur between a surface of at least one of said plurality of pressing members and the surface of said contact member.

25. A device as claimed in claim 24, wherein the discharge is caused to occur between the surface of at least a most upstream one of said plurality of pressing members in the direction of conveyance and the surface of said contact member.

26. A device as claimed in claim 25, wherein the most downstream one of said plurality of pressing members in the direction of conveyance is connected to ground.

27. A device as claimed in claim 21, further comprising a cleaning member for removing, after the recording medium has been released from said contact member, the solvent deposited on the surface of said contact member.

28. A device as claimed in claim 21, wherein said contact member and said pressing member each are implemented by a roller.

29. A device for fixing an image formed on a recording medium by fine colored particles dispersed in a solvent and capable of at least temporarily holding a charge in said solvent, said device comprising:

a contact member for contacting a first surface of the recording medium carrying the image; and a pressing member for pressing the recording medium against said contact member via a second surface of said recording medium opposite to the first surface to thereby press the image;

wherein a current is caused to flow between a surface of said contact member and a surface of said pressing member via the recording medium, and wherein the current is caused to flow by use of a constant current power source.

30. A device for fixing an image formed on a recording medium by fine colored particles dispersed in a solvent and capable of at least temporarily holding a charge in said solvent, said device comprising:

a contact member for contacting a first surface of the recording medium carrying the image; and a pressing member for pressing the recording medium against said contact member via a second surface of said recording medium opposite to the first surface to thereby press the image;

wherein a current is caused to flow between a surface of said contact member and a surface of said pressing member via the recording medium, and wherein before the image carried on the recording medium contacts said contact member, discharge is caused to occur between the surface of said contact member and the surface of said pressing member for feeding a charge to the colored particles forming said image.

31. A device for fixing an image formed on a recording medium by fine colored particles dispersed in a solvent and capable of at least temporarily holding a charge in said solvent, said device comprising:

a contact member for contacting a first surface of the recording medium carrying the image;

a pressing member for pressing the recording medium against said contact member via a second surface of said recording medium opposite to the first surface to thereby press the image; and heating means for heating the surface of said contact member;

wherein a current is caused to flow between a surface of said contact member and a surface of said pressing member via the recording medium, and wherein a potential difference above a discharge start voltage is set up between the surface of said contact member and the surface of said pressing member to thereby cause discharge to occur, and wherein when the recording medium is absent and when said contact member is warmed up to a fixing temperature, a value produced by differentiating said potential difference for a unit axial length by the current is selected to be greater than $1\times10^{-7}$ $A.V^{-1}.m^{-1}$ inclusive, but smaller than $1\times10^{-4}$ $A.V^{-1}.m^{-1}$ inclusive.

32. A device for fixing an image formed on a recording medium by fine colored particles dispersed in a solvent and capable of at least temporarily holding a charge in said solvent, said device comprising:

a contact member for contacting a first surface of the recording medium carrying the image; and a pressing member for pressing the recording medium against said contact member via a second surface of said recording medium opposite to the first surface to thereby press the image;

wherein a current is caused to flow between a surface of said contact member and a surface of said pressing member via the recording medium, and wherein an anode oxide film of aluminum is formed on a surface layer of said contact member.

33. A device for fixing an image formed on a recording medium by a developing liquid in which a carrier is partly or entirely implemented by a nonvolatile solvent, said device comprising:

a heat roller;

heat roller drive means for driving said heat roller; and a plurality of backup rollers sequentially arranged along a circumference of said heat roller;

wherein said plurality of backup rollers each press the recording medium toward said heat roller with a force which is less than 50 g/cm inclusive for a unit axial length of the backup roller.

34. A device as claimed in claim 33, wherein said heat roller and said plurality of backup rollers are spaced from each other by a preselected gap.

35. A device as claimed in claim 34, wherein said gap is formed by circumferential ridges formed on opposite end portions of said heat roller and each having a greater outside diameter than a fixing portion of said heat roller.

36. A device as claimed in claim 35, wherein said gap is greater than 20 $\mu$m inclusive, but smaller than 500 $\mu$m inclusive.

37. A device as claimed in claim 33, wherein a ratio of an outside diameter d of each of said plurality of backup rollers to an outside diameter D of said heat roller lies in a range of:

$$0<d/D\leqq0.5$$

38. A device as claimed in claim 33, further comprising backup roller drive means for driving said plurality of backup rollers.

* * * * *